US009310037B2

(12) United States Patent
Cercone

(10) Patent No.: US 9,310,037 B2
(45) Date of Patent: Apr. 12, 2016

(54) MOTORIZED LIGHTING FIXTURE WITH MOTOR AND LIGHT DIMMING CONTROL

(75) Inventor: Samuel P. Cercone, Aliquippa, PA (US)

(73) Assignee: Brightline, Inc., Bridgeville, PA (US)

( * ) Notice: Subject to any disclaimer, the term of this patent is extended or adjusted under 35 U.S.C. 154(b) by 1014 days.

(21) Appl. No.: 13/368,785

(22) Filed: Feb. 8, 2012

(65) Prior Publication Data

US 2013/0200818 A1 Aug. 8, 2013

(51) Int. Cl.

| | |
|---|---|
| ***F21S 8/02*** | (2006.01) |
| ***H05B 33/08*** | (2006.01) |
| ***F21V 14/02*** | (2006.01) |
| *H05B 37/02* | (2006.01) |

(52) U.S. Cl.

CPC ..... *F21S 8/026* (2013.01); *F21V 14/02* (2013.01); *H05B 33/0803* (2013.01); *H05B 33/0845* (2013.01); *H05B 37/0245* (2013.01)

(58) Field of Classification Search

USPC ..... 362/220, 285, 286, 287, 427, 428

See application file for complete search history.

(56) References Cited

U.S. PATENT DOCUMENTS

| | | | |
|---|---|---|---|
| 2,344,935 | A | 3/1944 | Whittaker |
| 3,287,552 | A | 11/1966 | Drandell |
| 3,643,086 | A | 2/1972 | Shaw |
| 3,702,928 | A | 11/1972 | Alger |
| 3,974,371 | A | 8/1976 | Miles, Jr. |
| 4,161,019 | A | 7/1979 | Mulvey |
| 4,171,535 | A | 10/1979 | Westermann |
| 4,180,850 | A | 12/1979 | Bivens |
| 4,204,274 | A | 5/1980 | Luderitz |
| 4,280,167 | A | 7/1981 | Ellett |
| 4,287,554 | A | 9/1981 | Wolff |
| 4,419,717 | A | 12/1983 | Price et al. |
| 4,454,569 | A | 6/1984 | Maguire |
| 4,511,954 | A | 4/1985 | Marcus et al. |
| 4,716,504 | A | 12/1987 | Pahl et al. |
| 4,729,080 | A | 3/1988 | Fremont et al. |
| 4,739,454 | A | 4/1988 | Federgreen |
| 4,779,178 | A | 10/1988 | Spitz |
| 4,811,177 | A | 3/1989 | Lauckhardt et al. |
| 4,855,886 | A | 8/1989 | Eijkelenboom et al. |
| 4,881,157 | A | 11/1989 | Pahl |
| 4,924,365 | A | 5/1990 | Bogdanovs |
| 4,947,297 | A | 8/1990 | Druffel et al. |
| 4,967,324 | A | 10/1990 | Barclay |
| 4,999,757 | A | 3/1991 | Poppenheimer |

(Continued)

FOREIGN PATENT DOCUMENTS

| | | | |
|---|---|---|---|
| DE | 2651912 | A1 | 5/1978 |
| DE | 19624707 | A1 | 1/1998 |

*Primary Examiner* — Laura Tso

(74) *Attorney, Agent, or Firm* — The Webb Law Firm

(57) ABSTRACT

A lighting fixture includes a housing defining a longitudinal axis, a lamp carriage assembly disposed inside the housing and supporting one or more lamps parallel with the longitudinal axis, and a motor coupled between the housing and the lamp carriage assembly and operative for pivoting the lamp carriage assembly relative to the housing about a pivot axis of the lamp carriage assembly. A method of operating the lighting fixture includes (a) causing a lamp carriage assembly disposed inside the housing to be in a home position and outputting light in response to illumination of the one or more lamps of the lamp carriage assembly, and (b) causing the lamp carriage assembly to pivot about its pivot axis thereby redirecting where the light output by the lamp carriage assembly travels in response to the illumination of the one or more lamps of the lamp carriage assembly.

11 Claims, 18 Drawing Sheets

(56) References Cited

U.S. PATENT DOCUMENTS

| | | | | |
|---|---|---|---|---|
| 5,025,349 | A | 6/1991 | Gow | |
| 5,050,047 | A | 9/1991 | Viner et al. | |
| 5,062,029 | A | 10/1991 | Engel | |
| 5,072,127 | A | 12/1991 | Cochran et al. | |
| 5,081,566 | A | 1/1992 | Crispin et al. | |
| 5,145,249 | A | 9/1992 | Bruckner | |
| 5,226,708 | A | 7/1993 | Katahira et al. | |
| 5,235,497 | A | 8/1993 | Costa | |
| 5,268,824 | A | 12/1993 | Czipri | |
| 5,412,551 | A | 5/1995 | Newell | |
| 5,564,815 | A | 10/1996 | Littman et al. | |
| 5,588,732 | A | 12/1996 | Sasaki et al. | |
| 5,609,408 | A | 3/1997 | Targetti | |
| 5,609,413 | A | 3/1997 | Lecluze | |
| 5,613,766 | A | 3/1997 | Raouf | |
| 5,615,942 | A | 4/1997 | Langis | |
| 5,672,002 | A | 9/1997 | Todd, Jr. | |
| 5,675,417 | A | 10/1997 | Ventura et al. | |
| 5,704,702 | A | 1/1998 | Goto | |
| 5,713,658 | A | 2/1998 | Stranagan, Jr. | |
| 5,713,662 | A | 2/1998 | Kira | |
| 5,803,585 | A | 9/1998 | Littman et al. | |
| 5,855,427 | A | 1/1999 | Lassovsky | |
| 6,129,444 | A | 10/2000 | Tognoni | |
| 6,230,172 | B1 | 5/2001 | Purnaveja et al. | |
| 6,517,216 | B1 | 2/2003 | Cercone et al. | |
| 2003/0231510 | A1* | 12/2003 | Tawa et al. | 362/528 |
| 2011/0116280 | A1* | 5/2011 | Lee et al. | 362/523 |

* cited by examiner

MOTORIZED LIGHTING FIXTURE WITH MOTOR AND LIGHT DIMMING CONTROL

BACKGROUND OF THE INVENTION

1. Field of the Invention

The present invention relates to lighting fixtures for plaster/drywall ceilings and dropped ceilings and, more particularly, to lighting fixtures that include directionally adjustable lighting.

2. Description of Related Art

Dropped ceilings are well known in the art as secondary ceilings that are hung below a main (structural) ceiling. Dropped ceilings are also referred to as a drop ceiling, false ceiling, or suspended ceiling, and are utilized widely in modern construction and architecture.

It is well known in the art for dropped ceilings to include one or more lighting fixtures that are supported by the gridwork of the dropped ceiling in a plenum space defined in the area above the dropped ceiling.

Plaster or drywall ceilings are also known in the art to include one or more lighting fixtures supported in one or more spaces above the ceilings, typically between joists that define the support structure of the plaster or drywall ceiling.

Heretofore, such lighting fixtures were configured to direct light in a single direction into a room below the ceiling. There is, however, a need in certain applications, such as, without limitation, video conferencing, distance learning, telemedicine, internet video streaming, and non-traditional studio environments, where directional control of the light output by a lighting fixture disposed in a ceiling would be desirable.

SUMMARY OF THE INVENTION

The invention is a lighting fixture comprising: an elongated housing (desirably an elongated housing that defines a longitudinal axis); at least one lamp carriage assembly (desirably an elongated lamp carriage assembly) disposed inside the housing and supporting one or more lamps (desirably parallel with the longitudinal axis of the housing); and at least one motor coupled between the housing and the lamp carriage assembly and operative for pivoting the lamp carriage assembly relative to the housing about a pivot axis of the lamp carriage assembly. Desirably, the pivot axis of the lamp carriage assembly runs parallel with the longitudinal axis of the housing.

The motor can be operative for pivoting the lamp carriage assembly under the control of a controller which controls the motor via wired, or wireless, or both wired and wireless communication.

The motor can be operative for pivoting the lamp carriage assembly about its pivot axis in a first direction, a second direction, or both the first and second directions.

Two lamp carriage assemblies can be disposed side-by-side in the housing. Each lamp carriage assembly can be pivotable about its pivot axis in a first direction, a second direction, or both the first and second directions independently of any other lamp carriage assembly. Two motors can be coupled between the two lamp carriage assemblies and the housing, with each motor coupled between one of the lamp carriage assemblies and the housing.

The lighting fixture can further include: a lamp holder coupled to the lamp carriage assembly and supporting the one or more lamps in fixed relation to the lamp carriage assembly; and a reflector disposed in the lamp carriage assembly such that light output by at least one of the one or more lamps is directed by the reflector away from an interior of the lamp carriage assembly.

Each lamp can comprise one of the following: an elongated fluorescent lamp supported by the lamp carriage assembly (desirably with a longitudinal axis of the fluorescent lamp parallel with the longitudinal axis of the housing); and/or a plurality of light emitting diodes (LEDs) supported by the lamp carriage assembly (desirably in a direction along the longitudinal axis of the housing).

At least one of the one or more lamps can be a fluorescent lamp. The lighting fixture can further include a fluorescent lamp ballast disposed in the housing and electrically coupled to the fluorescent lamp.

The housing can be a rectangular box-like structure having an open side. The lamp carriage assembly can support the one or more lamps to output light via the open side of the housing. Desirably, the one or more lamps output light through the open side of the housing via a lens. The lens can be coupled with the lamp carriage assembly and pivot with the lamp carriage assembly in response to the motor pivoting the lamp carriage assembly relative to the housing about the pivot axis of the lamp carriage assembly.

The invention is also a lighting method that utilizes a lighting fixture comprising a housing that desirably defines a longitudinal axis, at least one lamp carriage assembly disposed inside the housing and supporting one or more lamps, desirably parallel with the longitudinal axis of the housing, and at least one motor coupled between the housing and the lamp carriage assembly and operative for pivoting the lamp carriage assembly relative to the housing about a pivot axis of the lamp carriage assembly that desirably runs parallel with the longitudinal axis of the housing. The lighting method comprises: (a) causing a first motor to maintain a first lamp carriage assembly disposed inside the housing in a first position outputting light in response to illumination of the one or more lamps of the first lamp carriage assembly; and (b) following step (a), causing the first motor to pivot the first lamp carriage assembly about its pivot axis thereby redirecting where the light output by the first lamp carriage assembly is directed in response to the illumination of the one or more lamps of the first lamp carriage assembly.

The method can further include (c) causing the first motor to further pivot the first lamp carriage assembly about its pivot axis thereby further redirecting where the light output by first lamp carriage assembly is directed in response to the illumination of the one or more lamps of the first lamp carriage assembly. In step (c), the first lamp carriage assembly can be pivoted back to the first position.

In step (b) or step (c), the lamp carriage assembly can be pivoted about its pivot axis in the clockwise direction or the counterclockwise direction.

The lighting method can further include: (c) causing a second lamp carriage assembly disposed inside the housing to pivot about its pivot axis thereby redirecting where the light output by the second lamp carriage assembly is directed in response to the illumination of the one or more lamps of the second lamp carriage assembly, wherein the second lamp carriage assembly is pivoted in the same or a different direction than the first lamp carriage assembly, and the second lamp carriage is pivoted by the first motor or a second motor.

The invention is also a lighting fixture comprising: a housing defining an axis; a first lamp carriage assembly supported inside the housing for pivoting about a pivot axis of the first lamp carriage assembly that is parallel with the axis of the housing; one or more lamps carried by the first lamp carriage assembly; and a first motor coupled between the housing and the first lamp carriage assembly and operative for pivoting the first lamp carriage assembly relative to the housing about the pivot axis of the first lamp carriage assembly.

A second lamp carriage assembly can be supported inside the housing for pivoting about a pivot axis of the second lamp carriage assembly that is parallel with the axis of the housing. One or more lamps can be carried by the second lamp carriage assembly. A second motor can be coupled between the housing and the second lamp carriage assembly and operative for pivoting the second lamp carriage assembly relative to the housing about the pivot axis of the second lamp carriage assembly.

Each lamp carriage assembly can be pivoted about its pivot axis in a first direction, a second direction, or both the first and second directions independently of the other lamp carriage assembly.

The lighting fixture can further include a controller for controlling the operation of the first motor, or the second motor, or both the first and the second motors via wired, or wireless, or both wired and wireless communication.

Lastly, the invention is a lighting fixture control method that comprises: (a) providing a control system that is programmed to control a plurality of lighting fixtures, wherein each lighting fixture comprising a housing, at least one lamp carriage assembly disposed inside the housing and supporting one or more lamps, and at least one motor coupled between the housing and the lamp carriage assembly, said motor operative for pivoting the lamp carriage assembly relative to the housing about a pivot axis of the lamp carriage assembly; and (b) the control system receiving an input that causes the control system to (1) activate said motors to pivot the lamp carriage assemblies, (2) adjust the light output by the lamps, or (3) both.

Step (b) can include two or more of the lamp carriage assemblies being pivoted to direct light output by the lamps thereof in the same or different directions.

The method can further include: (c) the control system receiving another input that causes the control system to (1) activate said motors to further pivot the lamp carriage assemblies, (2) further adjust the light output by the lamps, or (3) both.

Adjusting the light output by the lamps in step (b) can include the control system adjusting the output of one or more lamps to be fully on, fully off, or partially on.

Step (b) can include: (b)(1) displaying on a visual display a first icon representing a lighting fixture that is under the control of the control system; (b)(2) in response to selection of the first icon, displaying a second icon on the visual display, wherein the second icon includes a virtual control related to either pivoting of the lamp carriage assembly of the lighting fixture represented by the first icon or an amount of light output by the one or more lamps of the lamp carriage assembly of the lighting fixture represented by the first icon; and (b)(3) adjusting the virtual control whereupon either the lamp carriage assembly of the lighting fixture represented by the first icon pivots or the amount of light output by the one or more lamps of the lamp carriage assembly of the lighting fixture represented by the first icon changes.

Step (b) can include: (b)(1) displaying on a visual display an icon representing a scene; and (b)(2) in response to selecting the icon, the control system controlling each of the plurality of lighting fixtures such that the motor of the lighting fixture pivots the lamp carriage assembly of the lighting fixture to a preprogrammed angle, the light output of the one or more lamps of the lamp carriage assembly of the lighting fixture changes to a preprogrammed percentage light output between 0% and 100%, or both.

DESCRIPTION OF THE PREFERRED EMBODIMENTS

The present invention will be described with reference to the accompanying figures where like reference numbers correspond to like elements.

The present invention is directed to a lighting fixture that is configured to be mounted above a ceiling.

Figure 1:
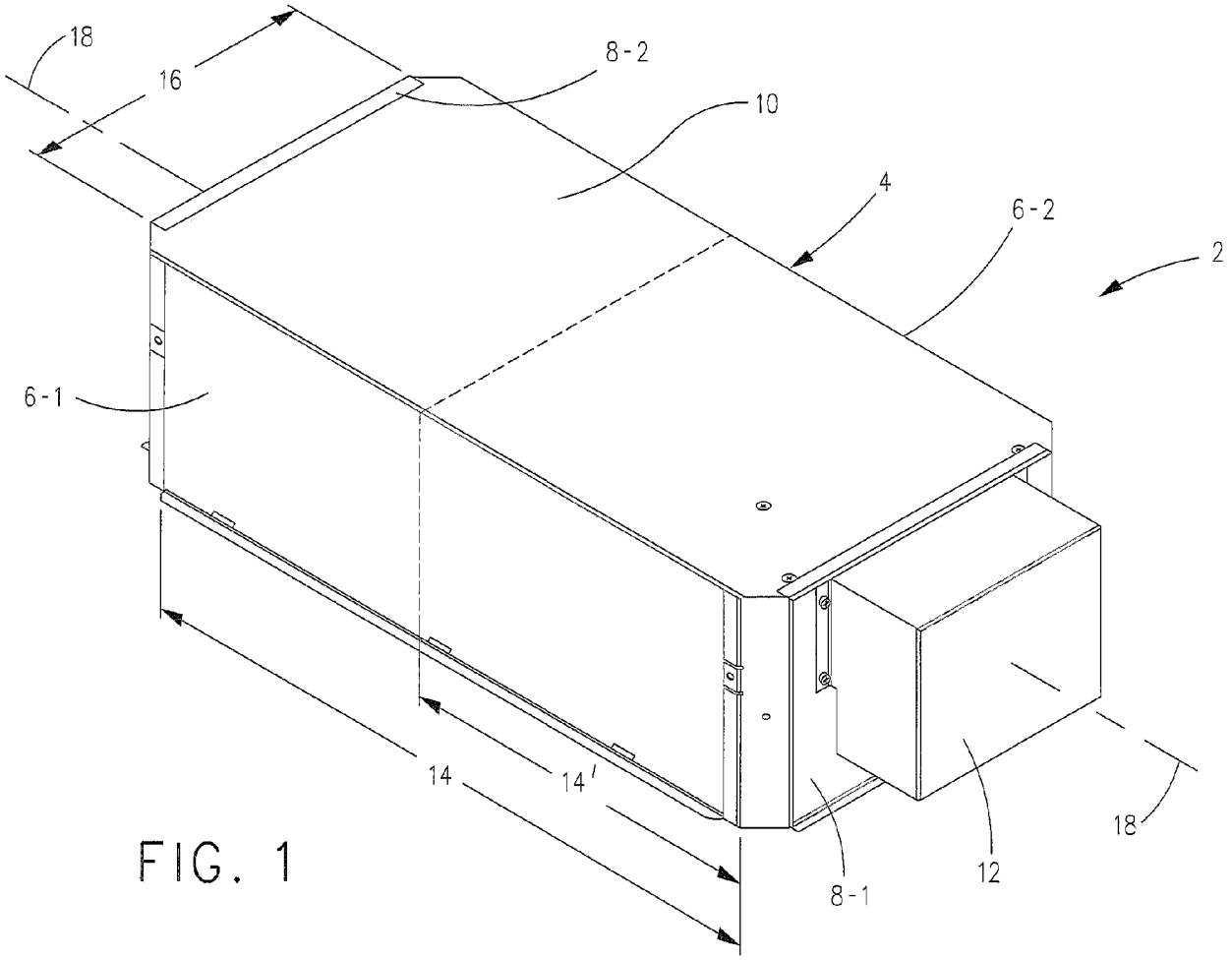
FIG. 1 is a perspective view of a top and two sides of a rectangular box-like housing that can be utilized with the embodiments of the lighting fixture of the present invention described hereinafter.

With reference to FIG. 1, a first embodiment lighting fixture 2 includes a housing 4 in the form of a rectangular box-like structure that includes a pair of sides 6-1 and 6-2 held in spaced relation by a pair of spaced ends 8-1 and 8-2. An optional top 10 can cover the top edges of sides 6-1 and 6-2 and ends 8-1 and 8-2.

An optional housing 12 can be coupled to any side or end of housing 4 of lighting fixture 2 to act as a dust and protective cover for one or more motors, one or more motor control circuits, and/or an AC-to-DC power supply to be described hereinafter.

In the embodiment of lighting fixture 2 shown in FIG. 1, the length 14 of sides 6 is longer than the length 16 of ends 8. However, this is not to be construed as limiting the invention since it is envisioned that the lengths 14 of sides 6 and the lengths 16 of ends 8 can be any suitable and/or desirable length. In the embodiment of lighting fixture 2 shown in FIG. 1, housing 4 defines a longitudinal axis 18 that extends through ends 8-1 and 8-2.

Figure 2:
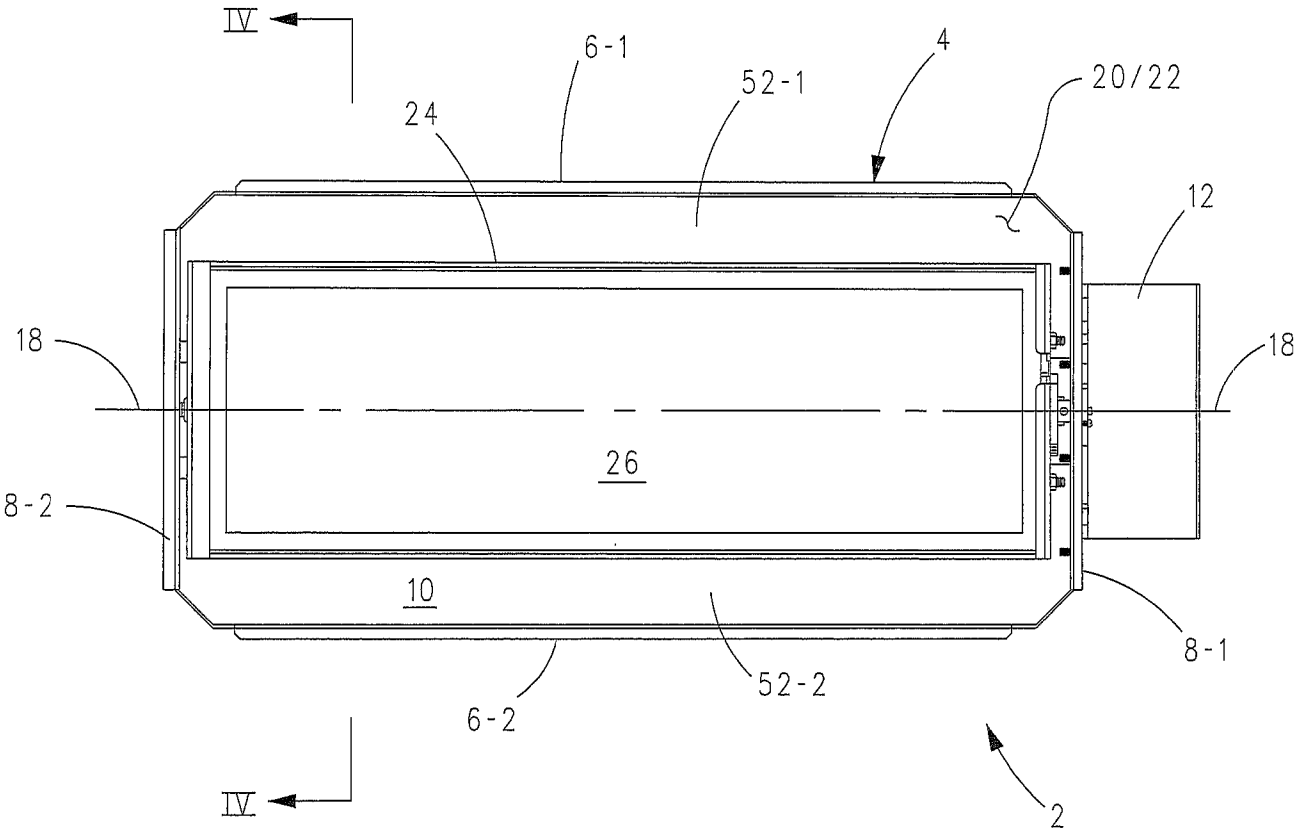
FIG. 2 is a bottom up view of the housing of FIG. 1 in accordance with one embodiment of the present invention.

With reference to FIG. 2 and with continuing reference to FIG. 1, in accordance with the first embodiment, housing 4 includes in an interior 20 thereof visible through an opening 22 in the bottom of housing 4 a single lamp carriage 24 that includes a lens 26 that faces away from optional top 10 of housing 4.

Figure 3:
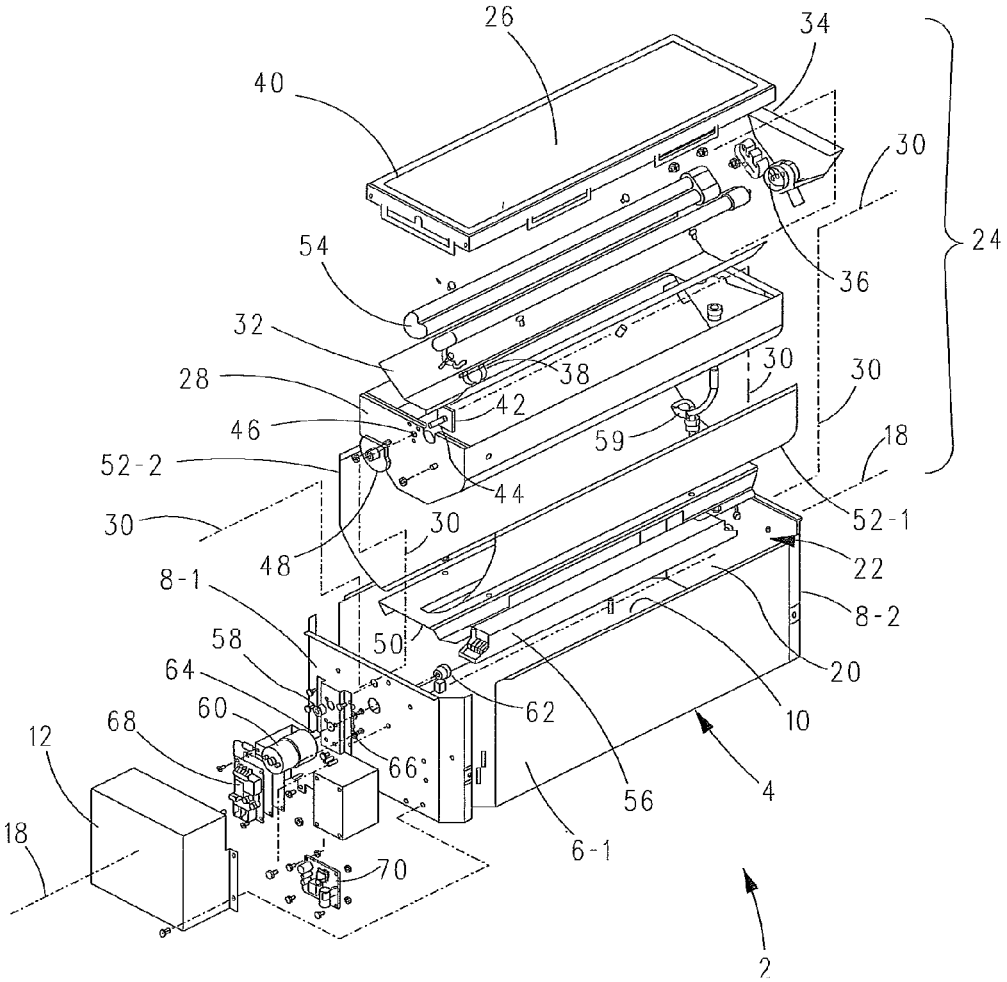
FIG. 3 is an exploded perspective view of the housing and the lamp carriage shown in FIG. 2.

With reference to FIG. 3 and with continuing reference to FIGS. 1 and 2, lamp carriage 24 includes a lamp carriage assembly 28 that defines a pivot axis 30, described in detail hereinafter, which runs parallel with longitudinal axis 18 of housing 4 when lamp carriage 24 is mounted in an assembled state into interior 20 of housing 4.

Lamp carriage 24 includes a reflector 32 and an end plate 34 coupled to lamp carriage assembly 28. End plate 34 supports at least one lamp holder 36. At least one lamp support 38 is affixed to reflector 32 adjacent an end thereof opposite lamp holder 36. Lamp carriage 24 further includes a lens frame 40 coupled to lamp carriage assembly 28 and configured to support lens 26 spaced from reflector 32. Lamp carriage 24 also includes a pivot bracket 42 that includes a shaft 44 that projects through a hole 46 in an end of lamp carriage assembly 28. Pivot bracket 42 is affixed to the end of lamp carriage assembly 28 so that shaft 44 does not rotate. A gear 48 is fixedly coupled for non-rotation to the portion of shaft 44 that projects through hole 46 in the end of lamp carriage assembly 28.

Lamp carriage 24 further includes a housing cover 50 which is coupled to top 10 and a pair of housing dome inserts 52-1 and 52-2 that co-act with housing cover 50 to form a dome-shaped structure in the interior 20 of lighting fixture 2 wherein lamp carriage assembly 28 is held for rotation (described hereinafter) within said dome-shaped structure.

In use of lighting fixture 2, each lamp holder 36 is mated with the mating electrical connection end of a lamp 54. Each lamp holder 36 and lamp 54 has mating connectors that enable electrical power to be supplied to lamp 54 via lamp holder 36 in a manner known in the art. While FIG. 3 shows lamp 54 as being in the form of a fluorescent lamp, this is not to be construed as limiting the invention since it is envisioned that lamp 54 in the form of a fluorescent lamp can be replaced with a plurality of LEDs that perform the same function. The end of lamp 54 opposite lamp holder 36 is held in place by lamp support 38 whereupon lamp 54 is held in fixed relation within lamp carriage assembly 28.

Where each lamp 54 is a fluorescent lamp, lighting fixture 2 includes a fluorescent lamp ballast 56 coupled to top 10 in a space defined between top 10 and one of the housing dome inserts 52. Ballast 56 is coupled to one or more lamp holders 36 via suitable electrical wiring 59 that facilitates the supply of electrical power from ballast 56 to each lamp 54 that is plugged into a lamp holder 36.

The end of shaft 44 that extends through gear 48 is received for rotation in a non-rotating bushing 58 supported by side 8-1 of housing 4. The end of lamp carriage assembly 28 opposite gear 48 is pivotally secured to end 8-2 in any suitable or desirable manner that enables lamp carriage assembly 28 to pivot about pivot axis 30 in a manner to be described hereinafter.

A motor 60 is coupled to gear 48 via a meshing gear 62 which is coupled to a shaft 64 of motor 60 for rotation therewith. Motor 60 can be fixedly supported to end 8-1 of housing 4 by any suitable and/or desirable means, such as, without limitation, a bracket 66. In one embodiment, motor 60 is coupled to an output of a motor control unit 68 which can be controlled to controllably rotate shaft 64 and, hence, gear 62 in a clockwise or counterclockwise direction. Motor control unit 68 is coupled to receive electrical power from an AC-to-DC power supply 70 which is operative for converting incoming AC electrical power into DC electrical power that motor control unit 68 can utilize to controllably rotate shaft 64 of motor 60 in a clockwise direction, or a counterclockwise direction, or both clockwise and counterclockwise directions as deemed suitable and/or desirable. Motor 60, motor control unit 68, and power supply 70 are desirably mounted to side 8-1 of housing 4 in any suitable and/or desirable manner, and housing 12 is coupled to side 8-1 of housing 4 covering motor 60, motor control unit 68, and power supply 70.

Figure 4:
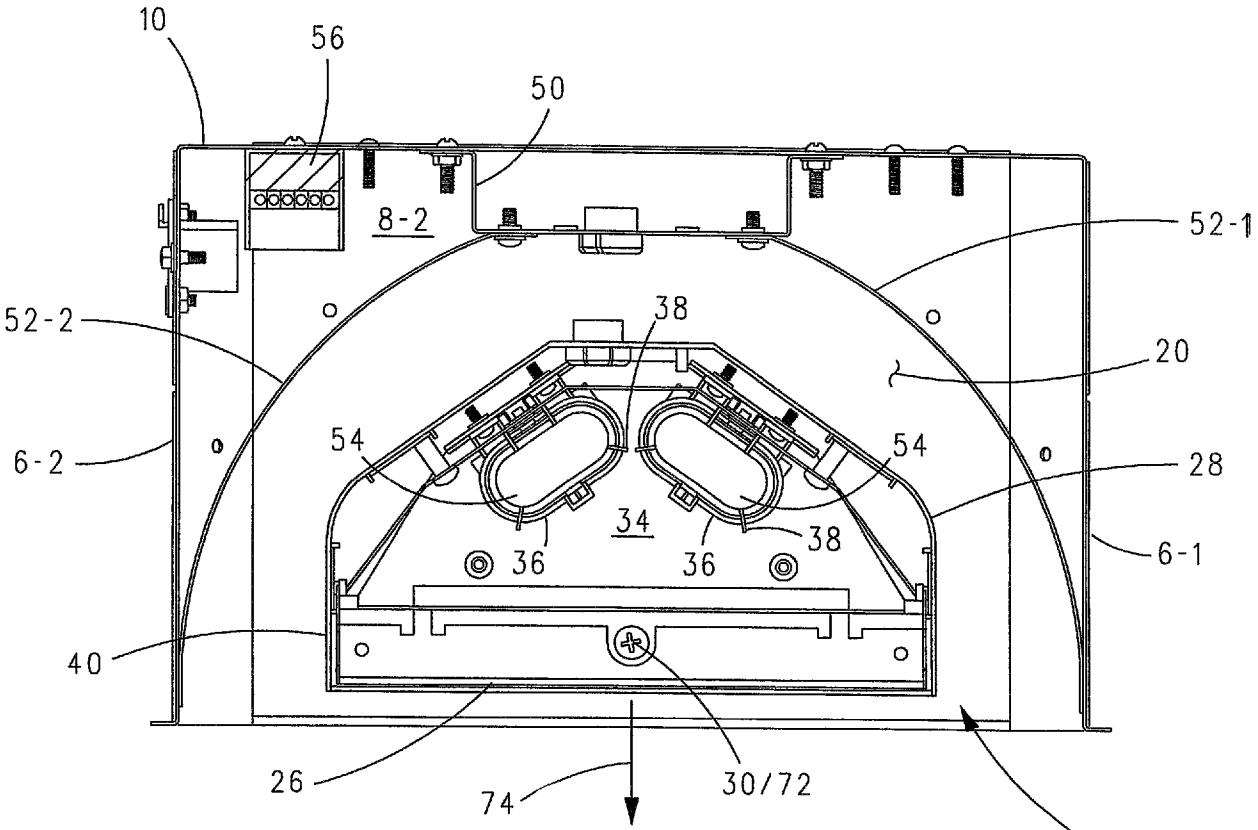
FIG. 4 is a section taken along lines IV-IV in FIG. 2.
Figure 5:
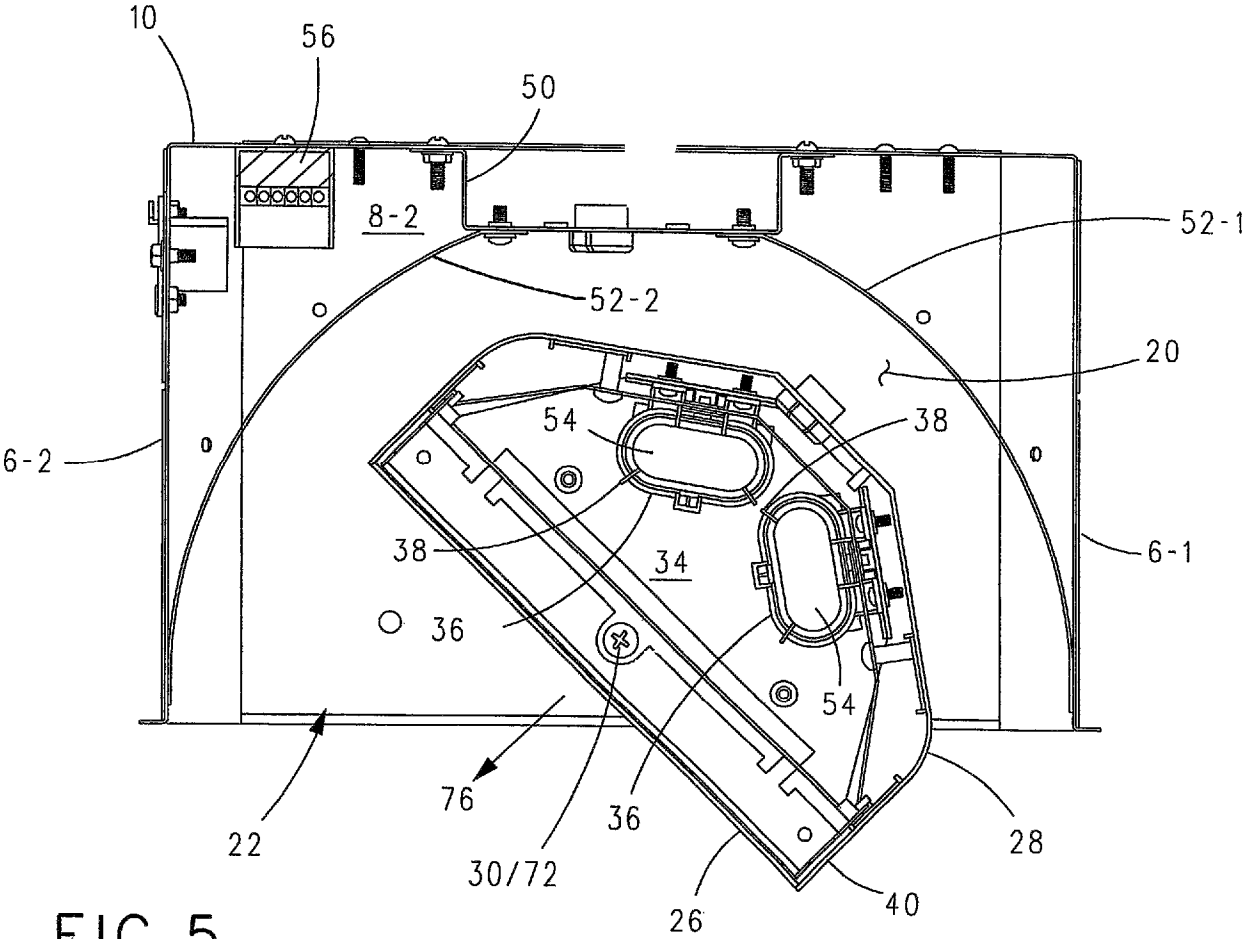
FIG. 5 shows the clockwise rotation of the lamp carriage assembly shown in FIG. 4.
Figure 6:
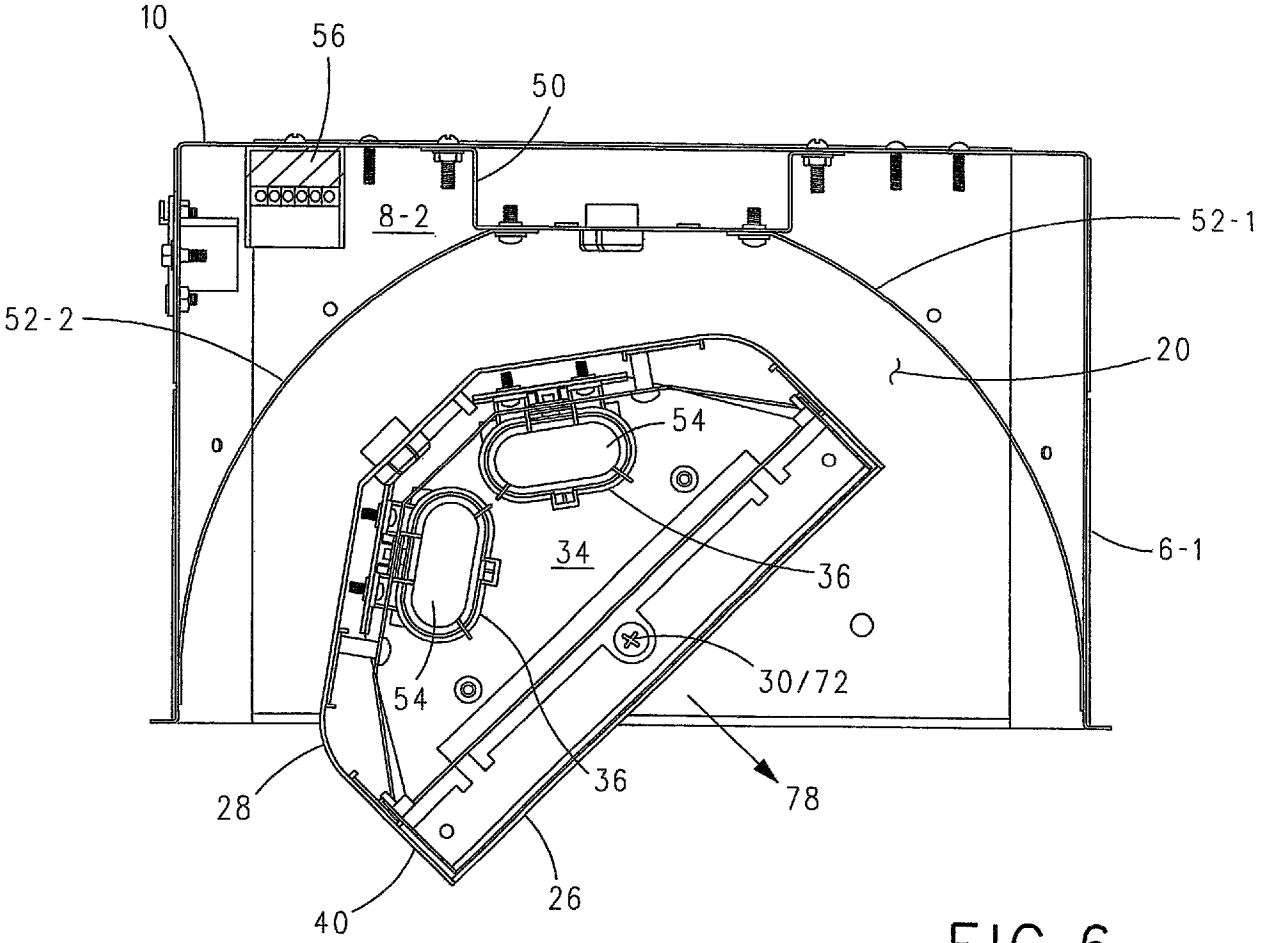
FIG. 6 shows the counterclockwise rotation of the lamp carriage assembly shown in FIG. 4.

With reference to FIG. 4 and with continuing reference to FIGS. 1-3, the end of lamp carriage assembly 28 opposite gear 48 pivots about a pivot 72 through which pivot axis 30 passes. FIG. 4 shows lamp carriage 24 in a "home" position where light output by lamp carriage 24 in response to illuminating each lamp 54 thereof is generally directed in the direction shown by arrow 74. In response to motor 60 receiving suitable electrical power from motor control unit 68, motor 60 can cause lamp carriage 24 to rotate from the home position shown in FIG. 4 in a clockwise direction to, for example, the position shown in FIG. 5 where light output by lamp carriage 24 in response to illumination of each lamp 54 thereof is directed generally in the direction shown by arrow 76. Also or alternatively, motor 60 can be controlled by motor control unit 68 to cause lamp carriage 24 to rotate in a counterclockwise direction to, for example, without limitation, the position shown in FIG. 6 where light output by lamp carriage 24 in response to illumination of each lamp 54 thereof is directed generally in the direction shown by arrow 78.

Figure 7:
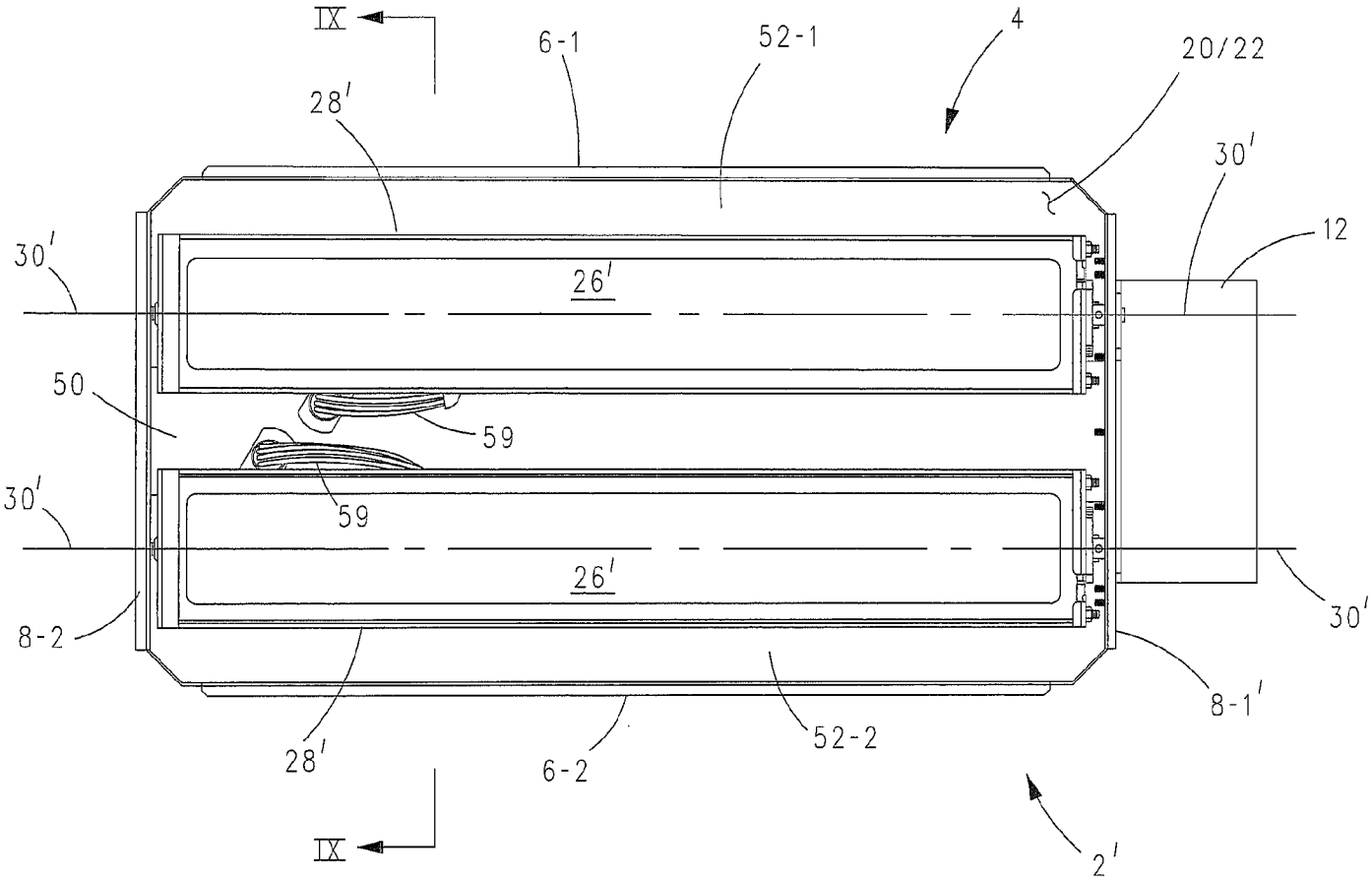
FIG. 7 is a bottom up view of the housing of FIG. 1 in accordance with another embodiment of the present invention.
Figure 8:
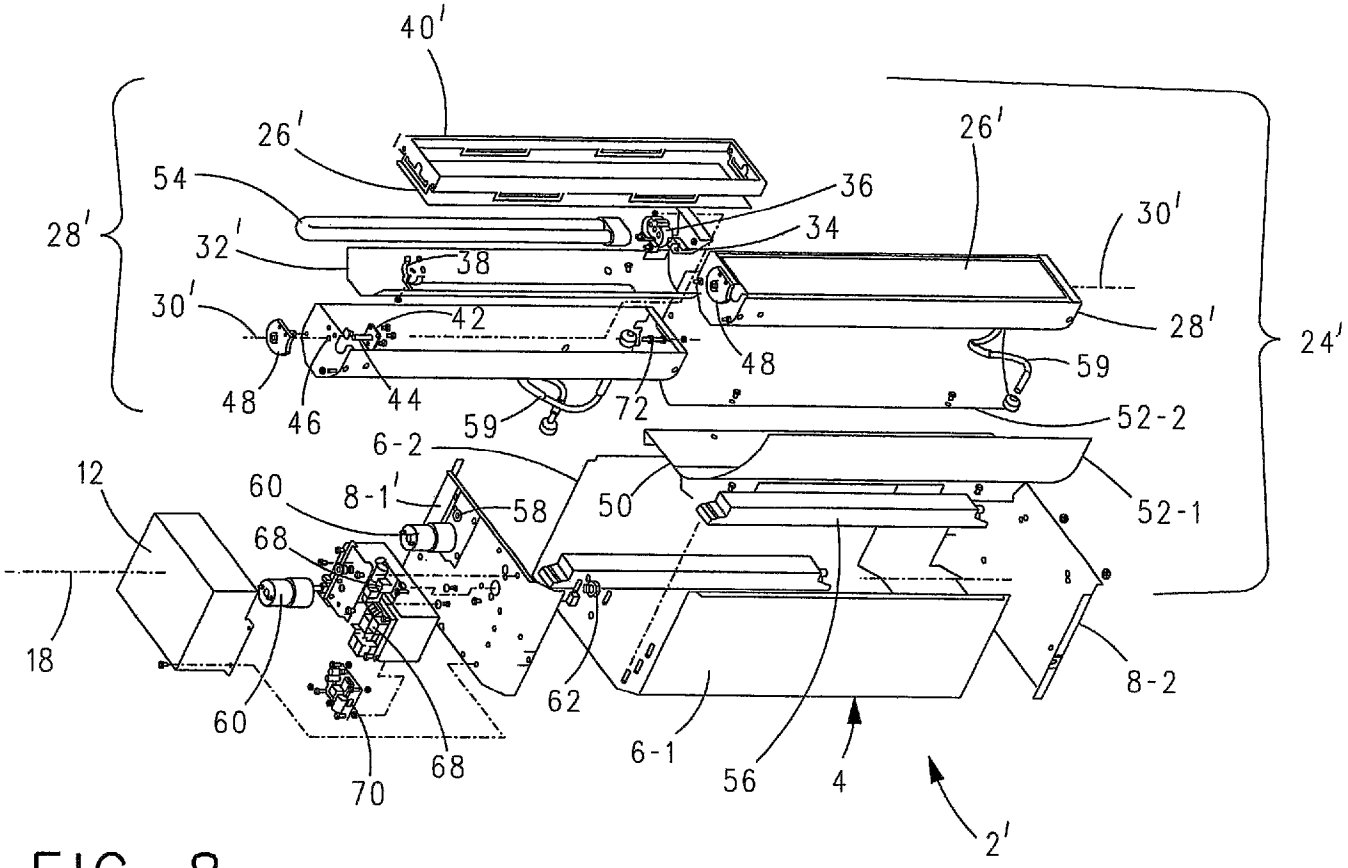
FIG. 8 is a partially exploded perspective view of the housing and the lamp carriage shown in FIG. 7.

With reference to FIGS. 7 and 8 and with continuing reference to FIGS. 1-6, in another embodiment lighting fixture 2', the single lamp carriage assembly 28 shown in FIGS. 2-6 can be replaced with two lamp carriages 28' disposed side-by-side in housing 4 in the manner shown in FIGS. 7 and 8 to form lamp carriage 24'.

Differences between lamp carriage assembly 28 shown in FIG. 3 and each lamp carriage assembly 28' shown in FIG. 8 can optionally include: each lamp carriage assembly 28' and its corresponding reflector 32', lens frame 40', and lens 26' can be narrower than the counterpart components 28, 32, 40, and 26 shown in FIG. 3; and each lamp carriage assembly 28' can carry a single lamp 54 versus the plurality, e.g., two, lamps 54 carried by lamp carriage assembly 28 shown in FIG. 3. However, it is envisioned that lamp carriage assembly 28 shown in FIG. 3 can alternatively carry a single lamp 54 instead of the two lamps 54 illustrated.

In the embodiment shown in FIGS. 7 and 8, each lamp carriage assembly 28' is coupled to its own motor 60 via its own gears 48 and 62 for independent rotation of said lamp carriage assembly 28' about its pivot axis 30'. Hence, each lamp carriage assembly 28' is independently rotatable about its pivot axis 30' via its respective motor 60. Alternatively, the pair of lamp carriage assemblies 28' shown in FIG. 8 can be coupled to a single motor 60 in a manner (not shown) that enables both lamp carriage assemblies 28' to be rotated together in the same direction or opposite directions about their respective pivot axes 30'.

As shown in FIG. 8, end 8-1' is different than end 8-1 in FIG. 3 to facilitate mounting of two motors 60 and two motor control units 68 thereto. Power supply 70 can be provided for supplying power to both motor control units 68. Housing 12 can be attached to end 8-1' to cover both motors 60, both motor control units 68, and power supply 70. Lighting fixture 2' shown in FIG. 8 can also include a pair of ballasts 56, with each ballast 56 coupled to one of the lamps 54 in one of the lamp carriage assemblies 28'. Alternatively, a single ballast 56 can be coupled to the lamps 54 in both of the lamp carriage assemblies 28'.

Figure 9:
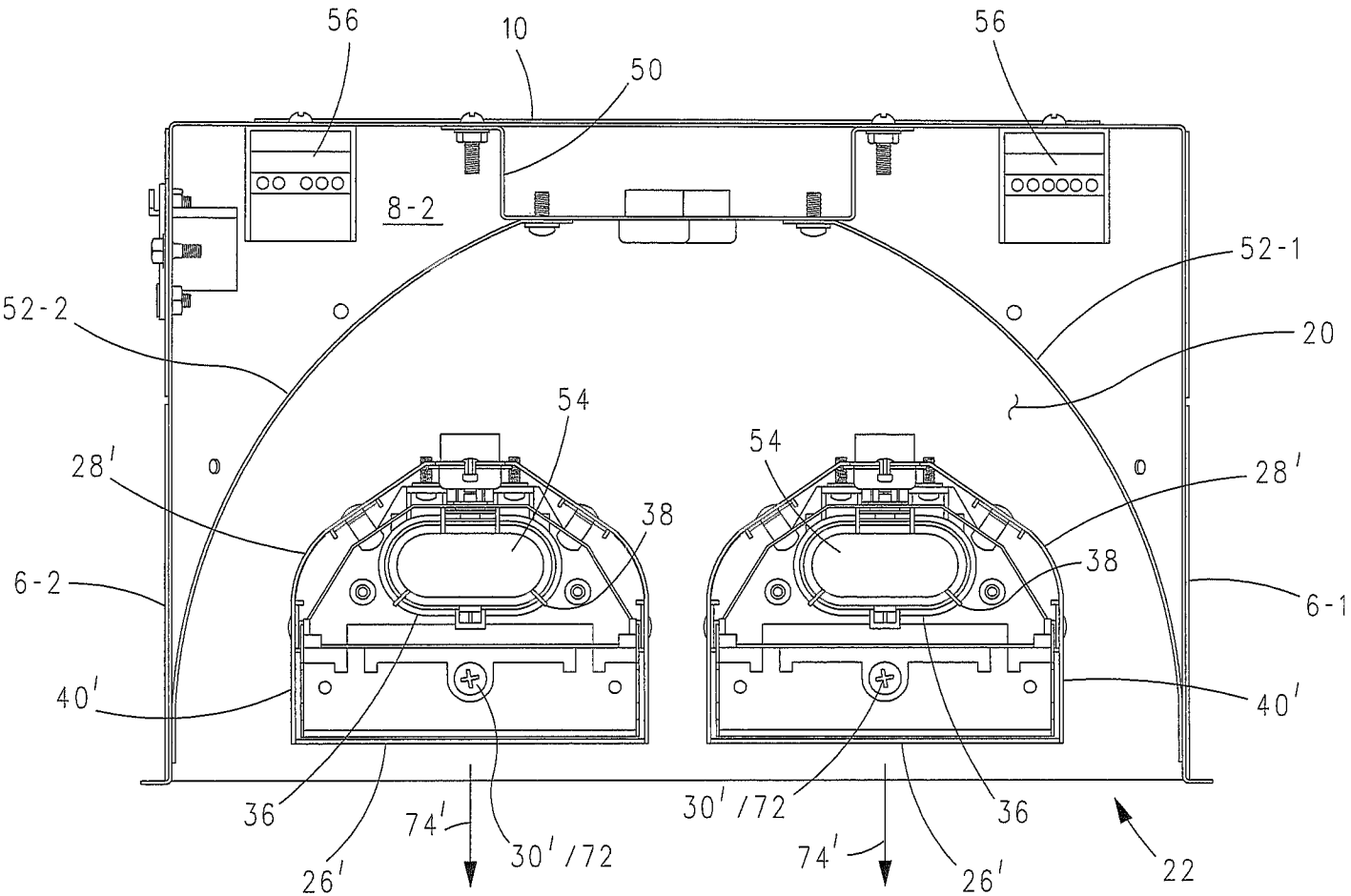
FIG. 9 is a cross-section taken along lines IX-IX in FIG. 7.

With reference to FIG. 9 and with continuing reference to FIGS. 7 and 8, under the control of their respective motors 60, each lamp carriage assembly 28' can be positioned in its "home" position shown in FIG. 9 wherein light output by each lamp carriage assembly 28' in response to illumination of the corresponding lamp 54 travels generally in a direction shown by arrows 74'. Each lamp carriage assembly 28' is rotatable by its corresponding motor 60 about its pivot axis 30'. The pivot axis 30' of each lamp carriage assembly 28' is defined by the shaft 44 of one of the pivot brackets 42 installed in one of the bushings 58 and the pivot point 72, which can be any suitable and/or desirable arrangement that enables said lamp carriage assembly 28' to pivot about its pivot axis 30'.

Figure 10:
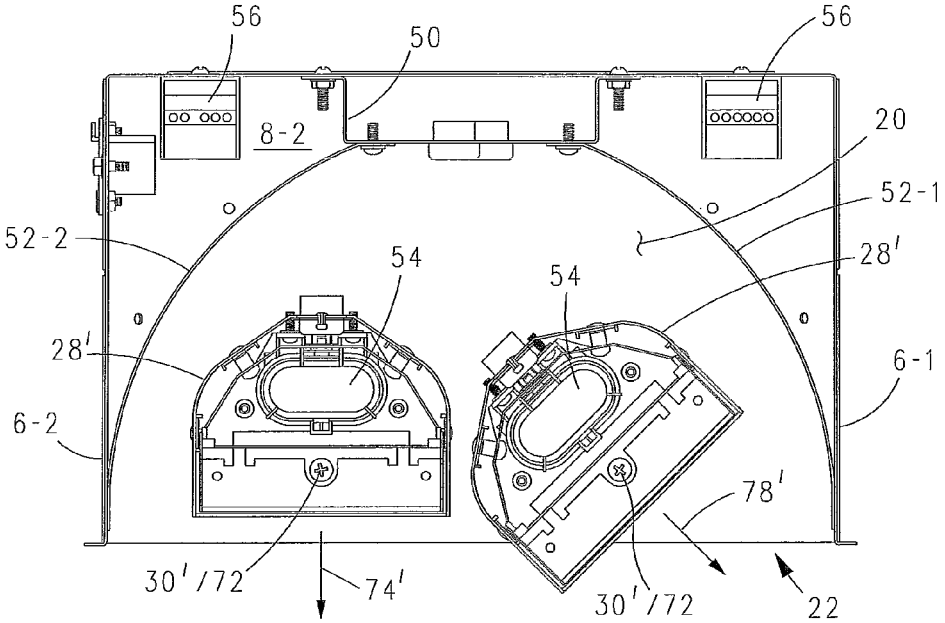
FIG. 10 shows the counterclockwise rotation of the right lamp carriage assembly of FIG. 9 while the left lamp carriage assembly remains in its home position.

With reference to FIGS. 10-15 and with continuing reference to FIG. 9, under the control of its respective motor 60, each lamp carriage assembly 28' can be independently pivoted about its pivot axis 30'. For example, as shown in FIG. 10, under control of the motor 60 coupled thereto, the right lamp carriage assembly 28' can be rotated counterclockwise about its pivot axis 30', to output light generally in the direction shown by arrow 7R' in response to illumination of lamp 54 thereof, while the motor 60 associated with the left lamp carriage assembly 28' can be controlled whereupon said left lamp carriage assembly 28' is in the home position outputting light generally in the direction shown by arrow 74' in response to illumination of lamp 54 thereof.

Figure 11:
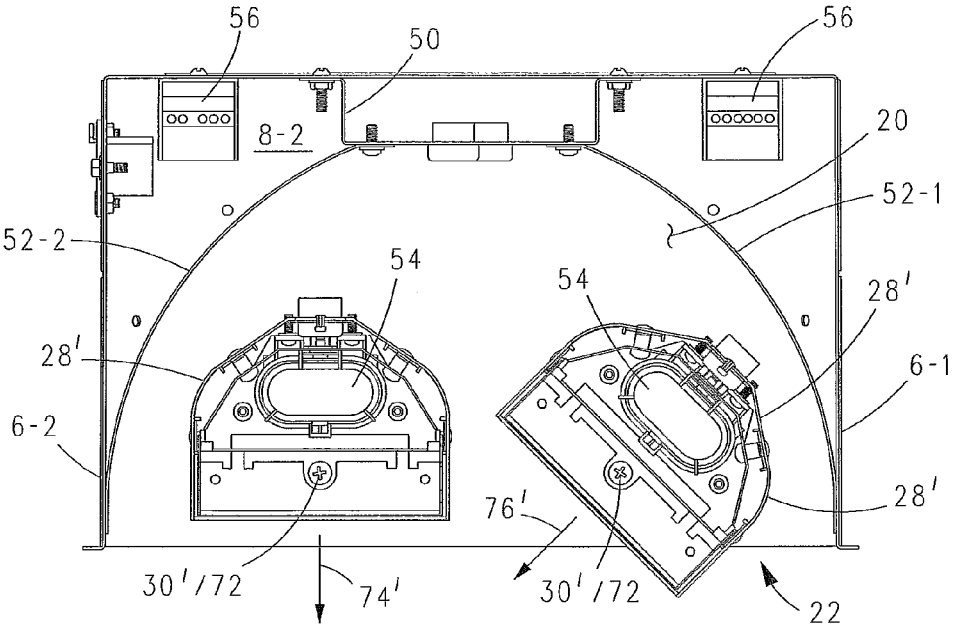
FIG. 11 shows the clockwise rotation of the right lamp carriage assembly of FIG. 9 while the left lamp carriage assembly remains in the home position.

As shown in FIG. 11, the motor 60 coupled to the right lamp carriage assembly 28' can be controlled to rotate said lamp carriage assembly 28' clockwise about its pivot axis 30' to output light generally in the direction shown by arrow 76' in response to illumination of lamp 54 thereof. At the same time, the motor 60 coupled to the left lamp carriage assembly 28' of FIG. 11 can be controlled whereupon said left lamp carriage assembly 28' is in the home position outputting light in the direction shown by arrow 74' in response to illumination of lamp 54 thereof.

Figure 12:
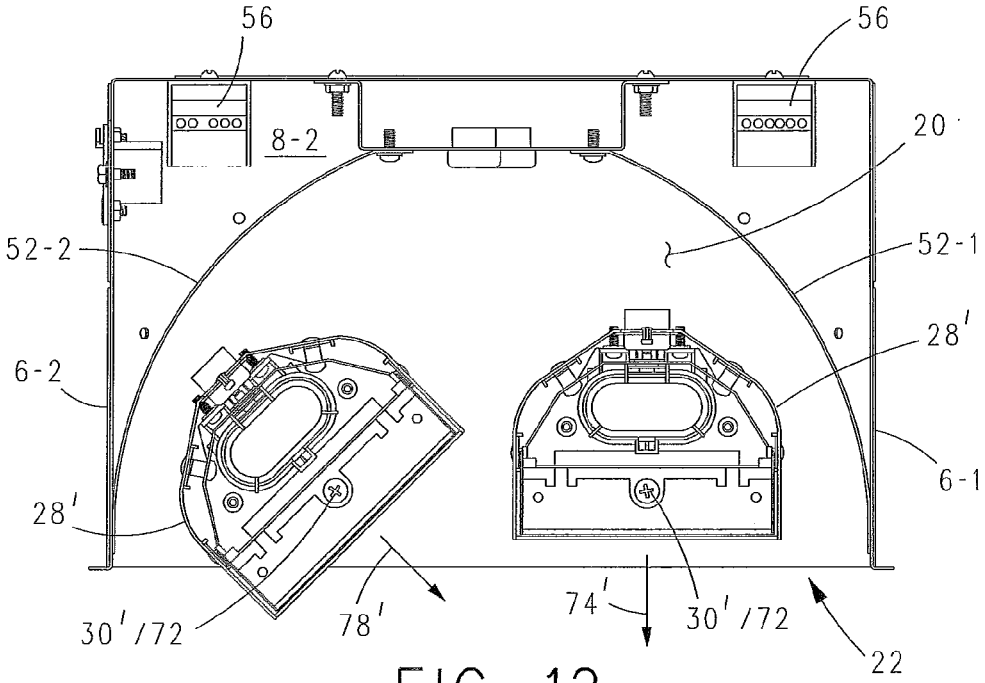
FIG. 12 shows the counterclockwise rotation of the left lamp carriage assembly of FIG. 9 while the right lamp carriage assembly remains in the home position.
Figure 13:
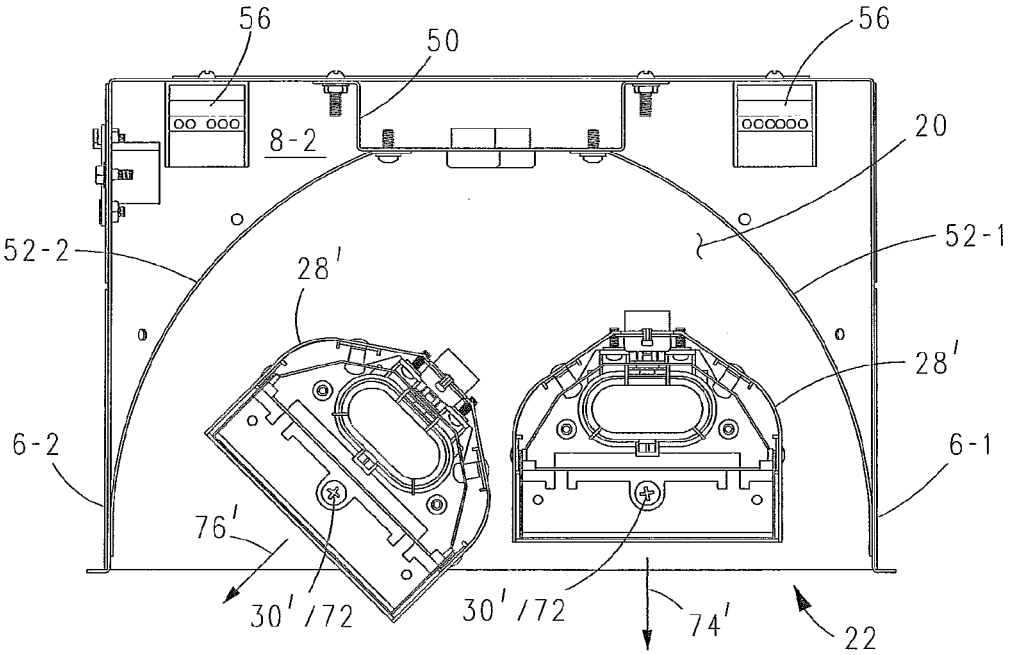
FIG. 13 shows the clockwise rotation of the left lamp carriage assembly of FIG. 9 while the right lamp carriage assembly remains in the home position.

FIGS. 12 and 13 illustrate the rotation of the left lamp carriage assembly 28' counterclockwise and clockwise about its pivot axis 30' to output light generally in the directions shown by arrows 78' and 76', respectively, while, at the same time, the right lamp carriage assembly 28' is maintained in its home position to output light generally in the direction shown by arrow 74'. In FIGS. 12 and 13, the counterclockwise and clockwise rotation of the left lamp carriage assembly 28' is under the control of the motor 60 coupled thereto and the right lamp carriage assembly 28' is maintained in its home position under the control of the motor 60 coupled thereto.

Figure 14:
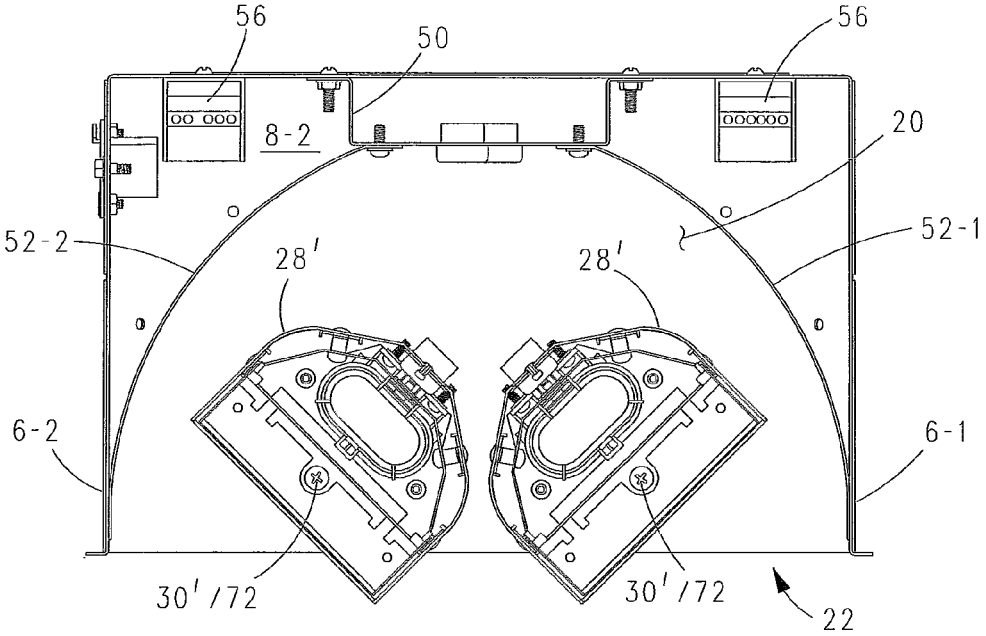
FIG. 14 shows the clockwise and counterclockwise rotations of the left and right lamp carriage assemblies shown in FIG. 9.

FIG. 14 illustrates the rotation of the left and right lamp carriage assemblies 28' clockwise and counterclockwise, respectively, about their respective pivot axes 30' by their respective motors 60.

Figure 15:
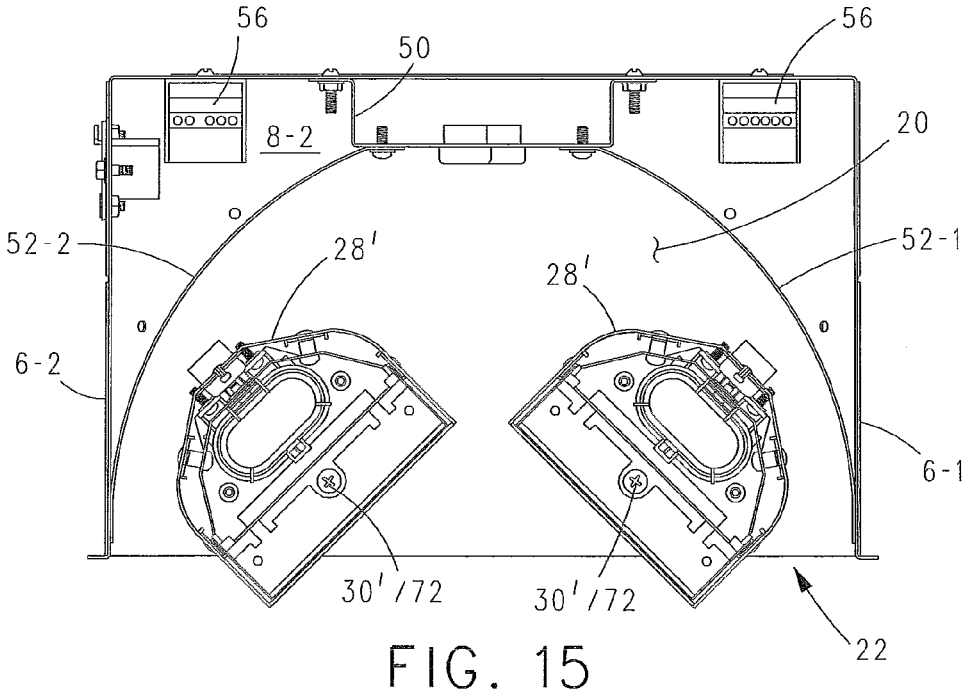
FIG. 15 shows the counterclockwise and clockwise rotations of the left and right lamp carriage assemblies shown in FIG. 9.

Lastly, FIG. 15 illustrates the rotation of the left and right lamp carriage assemblies 28' counterclockwise and clockwise, respectively, about their respective pivot axes 30' by their respective motors 60.

As can be seen from FIGS. 9-15, each lamp carriage assembly 28' can, under the control of its respective motor 60, be rotated clockwise, counterclockwise, or both clockwise and counterclockwise, independent of the rotation of the other lamp carriage assembly 28'. While not shown, the left and right lamp carriage assemblies 28' shown in FIGS. 9-15 can be pivoted or rotated by their respective motors 60 in the same direction so that the light output by both of said lamp carriage assemblies 28' is directed generally in the direction shown by arrow 74', arrow 76', or arrow 78' in FIGS. 9-15.

Desirably, each motor 60 can rotate the lamp carriage assembly 28 or 28' coupled thereto to any suitable and/or desirable position about its respective pivot axis 30 or 30'. For example, the motor 60 coupled to lamp carriage assembly 28 shown in FIG. 4 is capable of rotating said lamp carriage assembly 28 to any fixed angular rotation position about pivot axis 30 subject to the length of electrical wiring 59 coupled between housing cover 50 and lamp carriage assembly 28. Absent electrical wiring 59, it is conceivable that the motor 60 coupled to lamp carriage assembly 28 can rotate said lamp carriage assembly 28 to any suitable and/or desirable position about pivot axis 30. However, in practice, the maximum clockwise or counterclockwise rotation of lamp carriage assembly 28 about pivot axis 30 is limited to no more than about ±50 degrees clockwise or counterclockwise from the home position. Similar comments apply in respect of the rotation of each lamp carriage assembly 28' shown in FIGS. 7-15.

Figure 16:
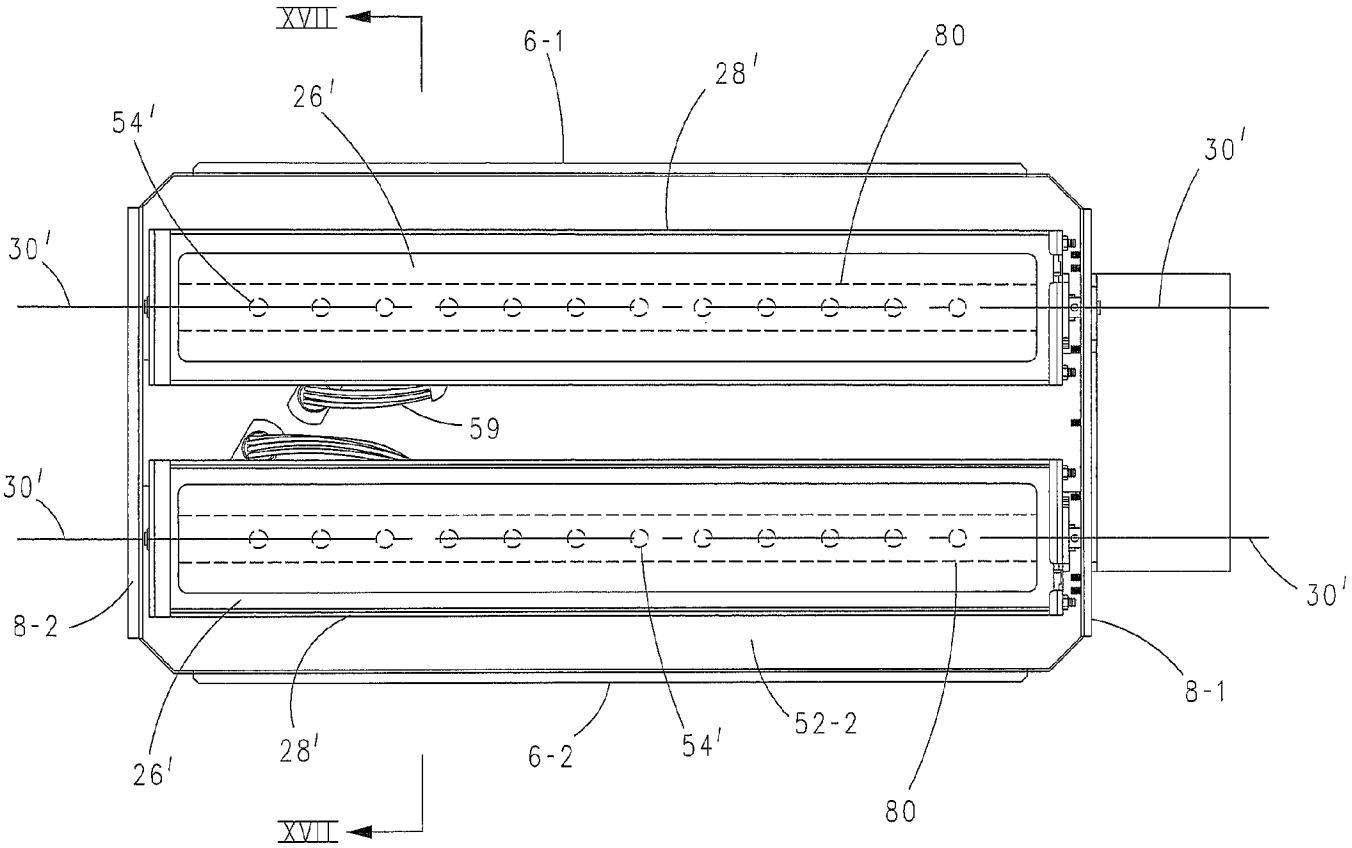
FIG. 16 shows another embodiment of the present invention wherein the lamp is comprised of a number of LEDs.
Figure 17:
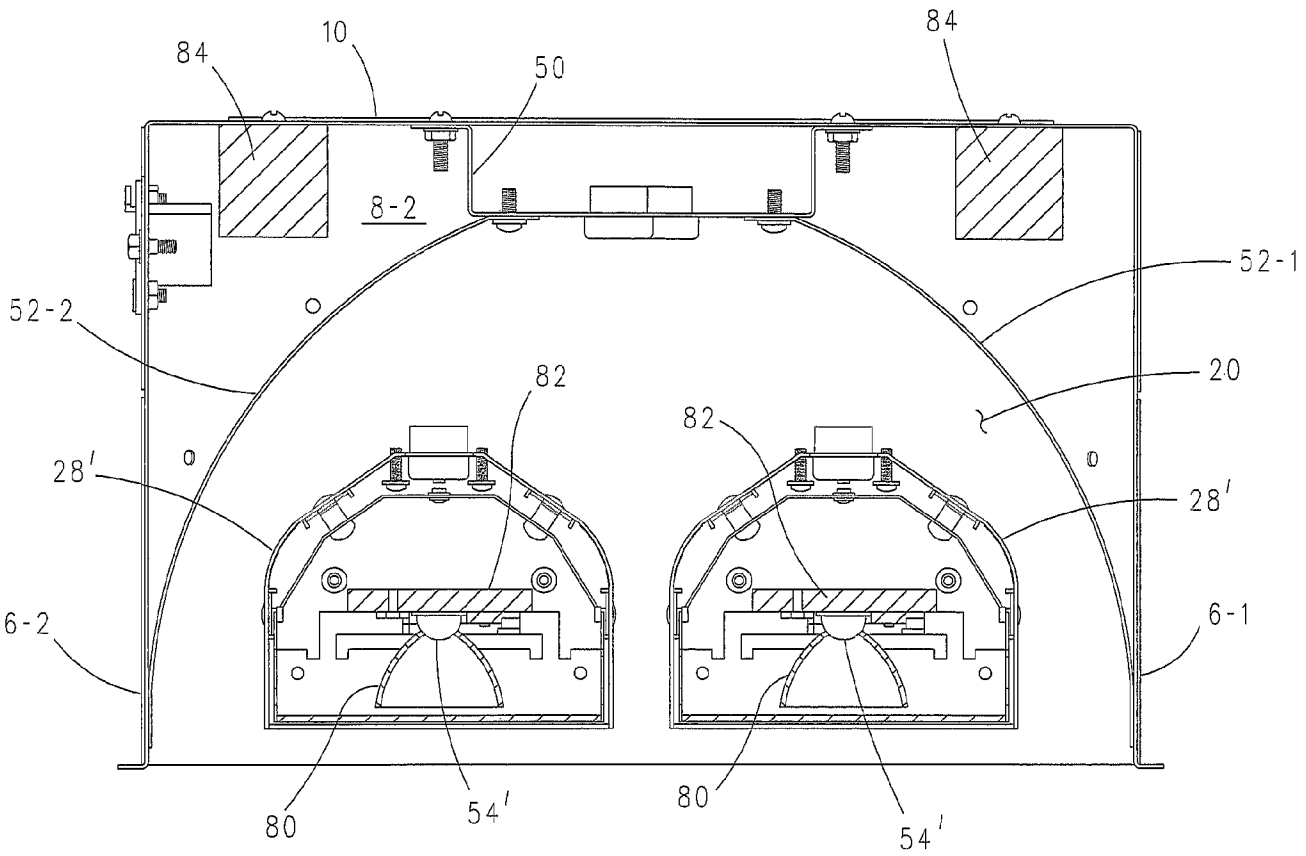
FIG. 17 is a section taken along lines XVII-XVII in FIG. 16.

With reference to FIGS. 16 and 17, each lamp 54 in the form of a fluorescent lamp can be replaced with a plurality lamps 54', each in the form of a light emitting diodes (LED) disposed along the length of pivot axis 30 or 30', as the case may be. For example, FIG. 16 shows a plurality of lamps 54', in the form of LEDs, in replacement of each lamp 54, in the form of a fluorescent lamp, shown in FIG. 8. Hereinafter, reference number 54' may be used interchangeable with lamps 54' and LED(s) 54'.

Each lamp carriage assembly 28' shown in FIGS. 16 and 17 includes a single, elongated reflector 80 (shown in phantom) disposed about LEDs 54' to reflect light output thereby in a desired direction. Alternatively, each lamp carriage assembly 28' can include two or more reflectors (not shown) with each reflector associated with one or more, but less than the total number of LEDs 54' of said lamp carriage assembly 28'. Hence, each lamp carriage assembly 28' can include anywhere between a single reflector 80 for all of the LEDs 54' and one reflector per LED 54' as deemed suitable and/or desirable. Desirably, each LED 54' of each lamp carriage assembly 28' is coupled to a heat sink 82 disposed on a side of the LED 54' opposite reflector 80 to dissipate heat generated by the LED 54'. Each LED 54' can be coupled to its own heat sink 82 or two or more (including all) of the LEDs 54' can be coupled to a single heat sink 82 which extends along the length of pivot axis 30' of lamp carriage assembly 28'.

Since lamps in the form of LEDs 54' operate off DC current, the ballasts 56 shown in, for example, FIGS. 3 and 8 can be replaced with one or more AC-to-DC power supplies 84 which are coupled to receive incoming AC power and to convert said AC power into DC power of a suitable voltage for the operation of each lamp 54' in the form of an LED.

Since the operation of each lamp carriage assembly 28' to pivot about its pivot axis 30' is the same as is shown in and discussed above in connection with the embodiment shown in FIGS. 8-15, the independent pivoting, clockwise and/or counterclockwise, of each lamp carriage assembly 28' which includes lamps 54' in the form of LEDs will not be described herein to avoid unnecessary redundancy.

While the use of lamps 54' in the form of LEDs has been described with reference to an embodiment of a light fixture 2 that includes two lamp carriage assemblies 28', it is to be appreciated that each lamp 54, its associated mounting hardware 36 and 38, and ballast 56 in the embodiment of FIG. 3 can be replaced by a number of lamps 54' in the form of LEDs including one or more reflectors 80, one or more heat sinks 82 and one or more AC-to-DC power supplies 84 of the type shown in connection with FIGS. 16 and 17. Hence, the disclosure herein of any particular type or form of lamp is not to be construed as limiting the invention.

Figure 18:
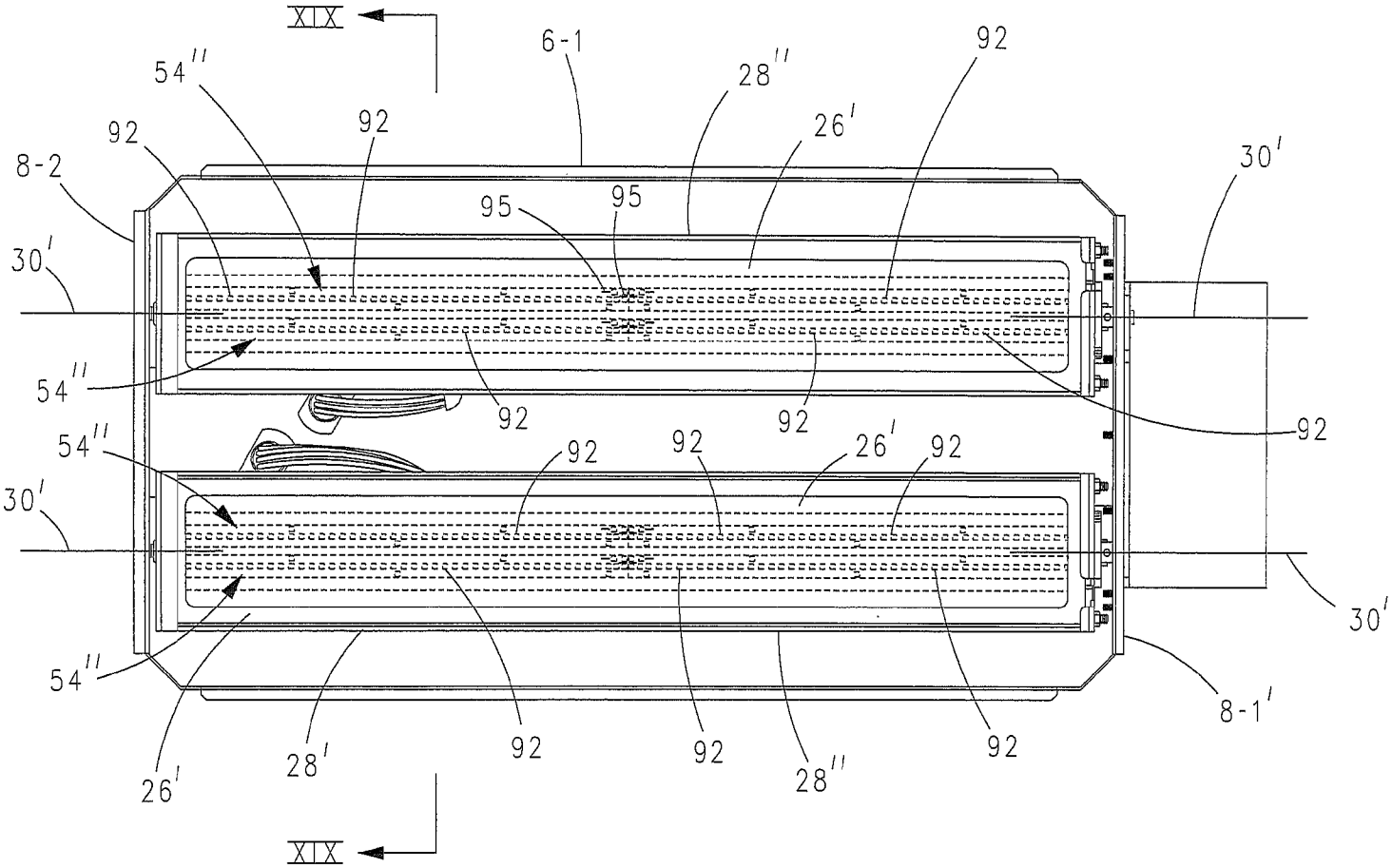
FIG. 18 shows another embodiment of the present invention where the lamp is comprised of one or more LED strips.
Figure 19:
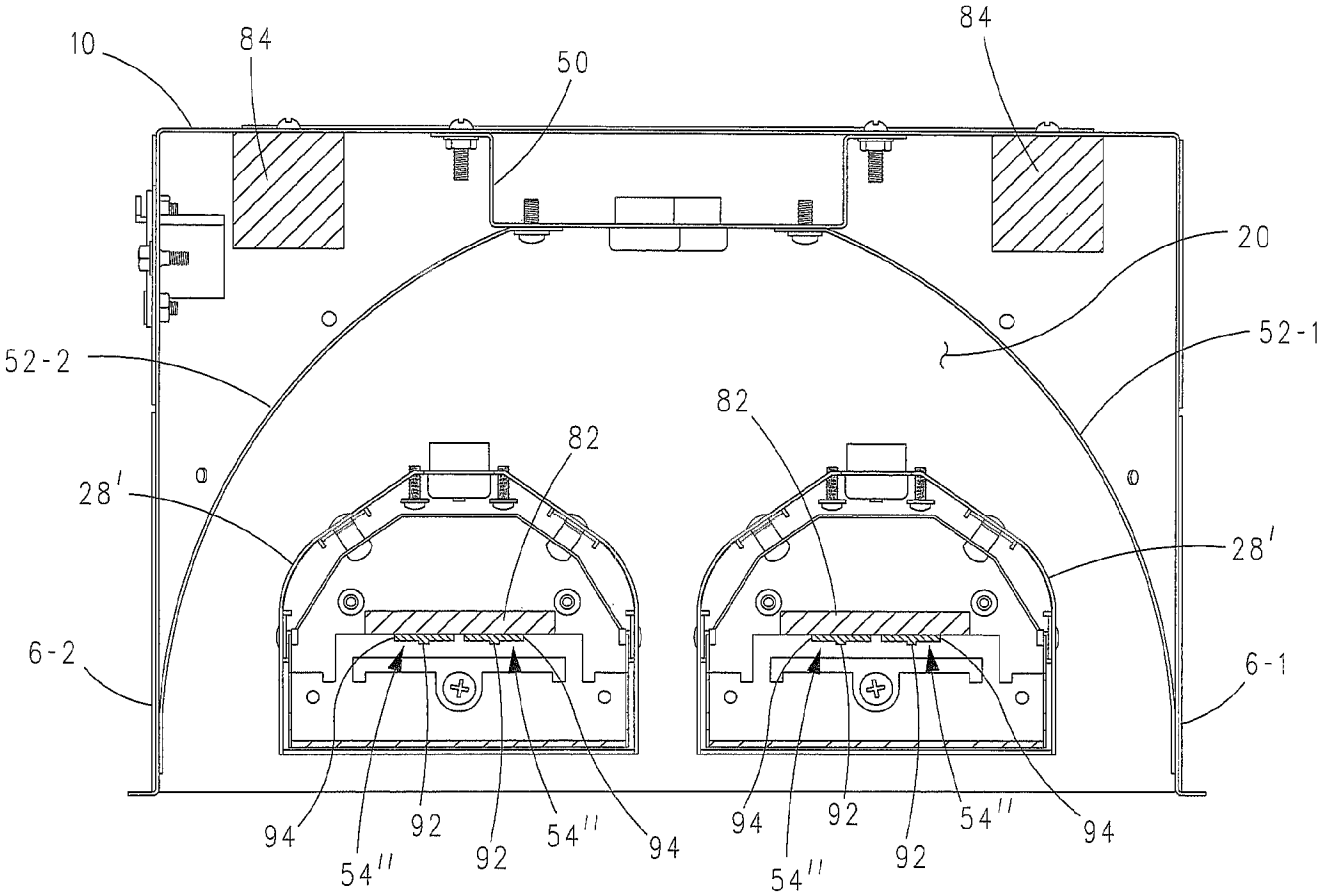
FIG. 19 is a section taken along XIX-XIX in FIG. 18.

With reference to FIGS. 18 and 19 and with continuing reference to FIGS. 16 and 17, instead of replacing each lamp 54 in the form of a fluorescent lamp with a plurality of lamps 54' in the form of standalone LEDs, each fluorescent lamp 54 can be replaced by one or more lamps 54" in the form of LED strips. Hereinafter, reference number 54" may be used interchangeable with lamps 54" and LED strip(s) 54".

Each LED strip 54" includes a plurality of LEDs 92 disposed on a rigid or flexible substrate 94 which desirably includes a suitable pattern of integral electrical conductors (not illustrated) to provide electrical power from an AC-to-DC power supply 84 to each of the LEDs 92 disposed on said substrate 94. In each of the LED strips 54" shown in FIGS. 18 and 19, a plurality of LEDs 92 is arranged in a single line that runs parallel with a longitudinal axis of pivot axis 30' of lamp carriage assembly 28". However, this is not to be construed as limiting the invention since it is envisioned that LEDs 92 of each LED strip 54" can be arranged in any suitable and/or desirable pattern.

In use thereof, the side of each LED strip 54" opposite LEDs 92 is coupled directly or indirectly to heat sink 82 which acts to dissipate heat generated by LEDs 92 during the operation thereof to generate light in response to receiving DC power from an AC-to-DC power supply 84.

Each LED strip 54" can run the complete or partial length of lamp carriage assembly 28". Alternatively, two or more LED strips 54" can be positioned end-to-end along the length of lamp carriage assembly 28". LED strips 54" arranged in end-to-end relationship can be connected in any suitable or desirable manner that facilitates each said LED strip 54" receiving electrical power from AC-to-DC power supply 84. For example, FIG. 18 includes four sets of two LED strips 54" positioned in end-to-end relationship. If desired, the pair of LED strips 54" comprising each set can be coupled to an AC-to-DC power supply 84 adjacent the ends of said LED strips 54" that are positioned adjacent to each other. Also or alternatively, the ends of each set of LED strips 54" that are adjacent to each other can have one or more electrical jumpers 95 running therebetween whereupon electrical power from AC-to-DC power supply 84 can be provided to the pair of LED strips 54" from the end of the pair of LED strips 54" adjacent end 8-2 or end 8-1'.

While the use of lamps in the form of LED strips 54" has been described with reference to an embodiment of a light fixture 2' that includes two lamp carriage assemblies 28", it is to be appreciated that each lamp 54, its corresponding mounting hardware 36 and 38, and ballast 56 in the embodiment of FIG. 3 can be replaced with one or more lamps 54" in the form of LED strips coupled directly or indirectly to one or more heat sinks 82 and one or more AC-to-DC power supplies 84. Hence, the disclosure herein of any particular type or form of lamp is not to be construed as limiting the invention.

It is envisioned that each lamp 54, 54', or 54" can be suitably controlled by either ballast 56 (lamp 54) or AC-to-DC power supply 84 (lamps 54', 54") in any suitable and/or desirable manner, including, without limitation, either manually or via an integrated control system (described hereinafter). In one non-limiting embodiment, each lamp carriage assembly 28, 28', and 28" is rotatable from its home position clockwise 50 degrees and counterclockwise 50 degrees in one-degree increments. However, this is not to be construed as limiting the invention.

Figure 20:
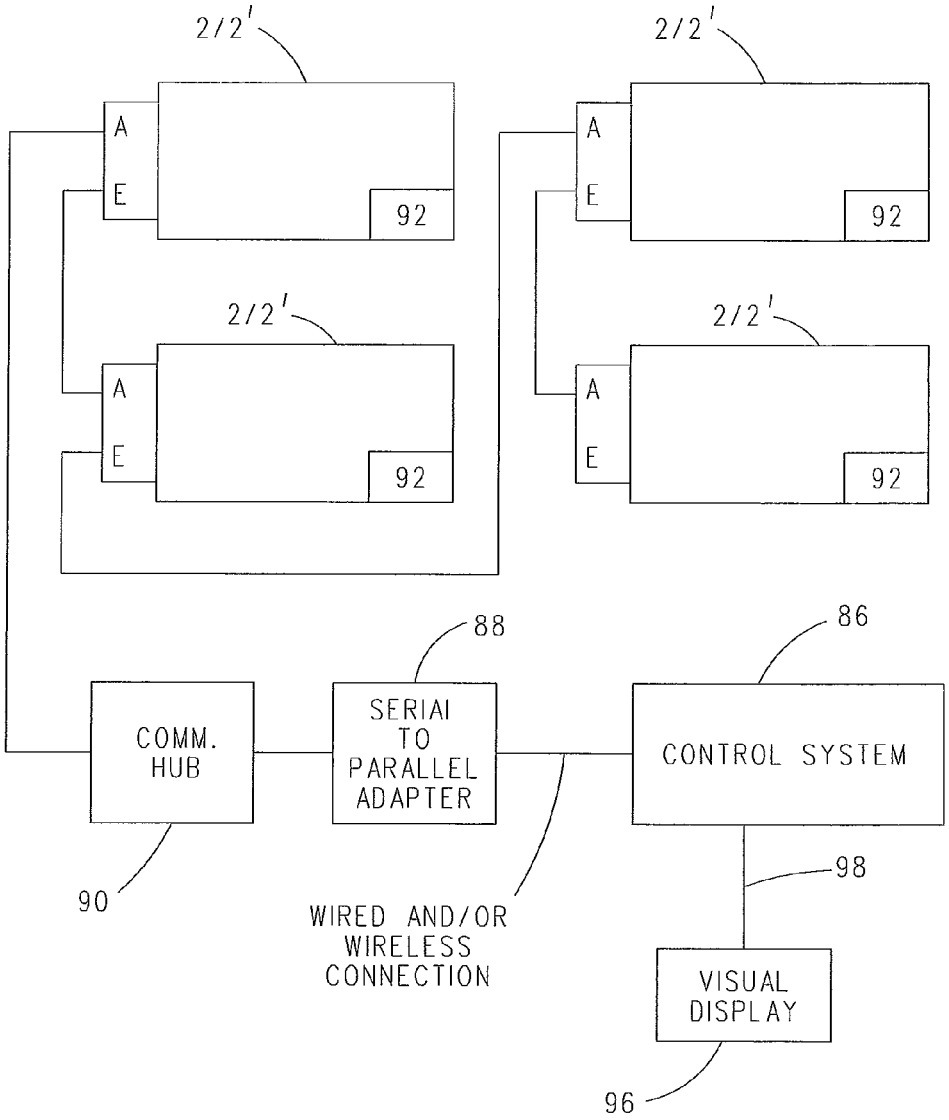
FIG. 20 is a schematic diagram of a control system for controlling the rotation of a number of lamp carriage assemblies and/or the amount of light output by the lamps thereof of a number of different lighting fixtures in accordance with the present invention.

With reference to FIG. 20, it is envisioned that each lamp carriage assembly 28, 28', and/or 28" of a number of different lighting fixtures 2/2' can be independently controlled by a control system 86 via a serial-to-parallel adapter 88 and a communication hub 90. More specifically, each motor control unit 68 can be assigned a unique network address whereupon control system 86 can control each motor 60 coupled to said motor control unit 68 to rotate each lamp carriage assembly 28, 28', and/or 28" coupled to said motor 60 clockwise, counterclockwise, or both clockwise and counterclockwise independently of each other motor 60 rotating its corresponding lamp carriage assembly or assemblies 28, 28', and/or 28". In the embodiment illustrated in FIG. 20, lighting fixtures 2/2' are connected in series with communication hub 90. However, this is not to be construed as limiting the invention since it is envisioned that lighting fixtures 2/2' can be connected in parallel or in any combination of serial and parallel deemed suitable and/or desirable by one of ordinary skill in the art.

In the embodiment shown in FIG. 20, when it is desired to pivot or rotate a lamp carriage assembly 28, 28', and/or 28" clockwise or counterclockwise, control system 86 outputs a suitable serial data stream that includes the data address of the motor control unit 68 that powers the motor 60 coupled to said lamp carriage assembly 28, 28', and/or 28". Serial-to-parallel adapter 88 converts the serial data output by control system 86 into parallel data. Communication hub 90 then translates said parallel data into a control data that is dispatched to the motor control unit 68 of the motor 60 coupled to said lamp carriage assembly 28, 28', and/or 28" to be rotated or pivoted. In this manner, control system 86 can control the pivoting or rotation of each lamp carriage assembly 28, 28', and/or 28" independently of each other.

Also or alternatively, control system 86, serial-to-parallel adapter 88, and communication hub 90 can be configured to pivot or rotate two or more or all of the lamp carriage assemblies 28, 28', and/or 28" of the lighting fixtures 2/2' in FIG. 18 in the same or different directions (clockwise or counterclockwise), either independently or substantially simultaneously.

It is also envisioned that control system 86, serial-to-parallel adapter 88, and communication hub 90 can also or alternatively be operatively coupled to one or more ballasts 56, as provided, and/or to one or more AC-to-DC power supplies 84, as provided, to control the fully on, or fully off, or percent-on operation of the respective lamp(s) 54, 54', and/or 54" coupled to said one or more ballasts 56 and/or said one or more AC-to-DC power supplies 84. To this end, it is envisioned that one or more ballasts 56 and/or one or more AC-to-DC power supplies 84 can be independently controlled by control system 86 via serial-to-parallel adapter 88 and communication hub 90. More specifically, each ballast 56 and/or each AC-to-DC power supply 84 can be assigned a unique network address whereupon control system 86 can control the state of lamp(s) 54, 54', and/or 54" coupled to said ballast 56 and/or AC-to-DC power supply 84 to be fully on, or fully off, or partially on.

The capability of a ballast 56 and/or an AC-to-DC power supply 84 to have a network address can be provided via network circuitry provided as part of the ballast 56 and/or the AC-to-DC power supply 84. Also or alternatively, the network address capability of one or more ballasts 56 and/or one or more AC-to-DC power supplies 84 can be provided by one or more external network circuits (or cards) 93, with each external network circuit 93 coupled to one or more ballasts 56 and/or one or more AC-to-DC power supplies 84. Each network circuit 92, albeit an external network circuit or a network circuit that is part of a ballast 56 and/or an AC-to-DC power supply 84, can be assigned a unique network address that can be addressed by control system 86 via serial-to-parallel adapter 88 and communication hub 90, and can include, either alone or in combination with one or more ballasts 56 and/or one or more AC-to-DC power supplies 84 coupled to said network circuit 92, additional circuitry as required to enable control system 86 to control the fully on, or fully off, or partially on state, e.g., without limitation, 15% on to 90% on, of one or more lamp(s) 54, 54', and/or 54".

It is envisioned that under the control of a software program, control system 86 can control the pivoting or rotation of each lamp carriage assembly 28, 28', and/or 28" and/or the fully on, or fully off, or partially on state of each lamp 54, 54', and/or 54" coupled to control system 86 via serial-to-parallel adapter 88 and communication hub 90 in any suitable and/or desirable manner. For example, under the control of the software program, control system 86 can cause each of one or a number of lamp carriage assemblies 28, 28', and/or 28" to rotate or pivot to a desired position. Simultaneously or independently, control system 86, operating under the control of the software program, can cause each of one or a number of lamps 54, 54', and/or 54" to assume a fully on state, or a fully off state, or a partially on state.

In one example, under the control of a first thread of execution of the software program, and starting from a state where each lamp carriage assembly 28, 28', and/or 28" is in its home position with all of the lamps 54, 54', and/or 54" in their fully on states, control system 86 can be activated to control the pivoting of one or more of said lamp carriage assemblies 28, 28', and/or 28" and the light output (fully on, or fully off, or partially on) of each of one or more lamps 54, 54', and/or 54" of said one or more lamp carriage assemblies 28, 28', and/or 28" for, e.g., a video conference application—where, for example, light is directed in a direction other than the direction the light is directed when each lamp carriage assembly 28, 28', and/or 28" is in its home position, and the output of a subset of the lamps 54, 54', and/or 54" is controlled to be fully off, fully on, or partially on.

Upon completion of the video conference, each lamp carriage assembly 28, 28', and/or 28" can be rotated or pivoted back to its home position and the output of each of lamp 54, 54', and/or 54" can be returned to its fully on state by control system 86 which can be activated under the control of a second thread of execution of the software program. Each such thread of execution of the software program can be programmed into control system 86 and independently selectable via a human machine interface of control system 86 (described hereinafter). In this way, the pivoting or rotation of a plurality of lamp carriage assembly 28, 28', and/or 28" and the output (fully on, fully off, or partially on) of each lamp 54, 54', and/or 54" of said plurality of lamp carriage assembly 28, 28', and/or 28" can be automatically controlled by control system 86 in concert in any suitable and/or desirable manner that facilitates the realization of a number of different scene lighting arrangements by the lamps 54, 54', and/or 54" of said lamp carriage assemblies 28, 28', and/or 28".

Figure 21:
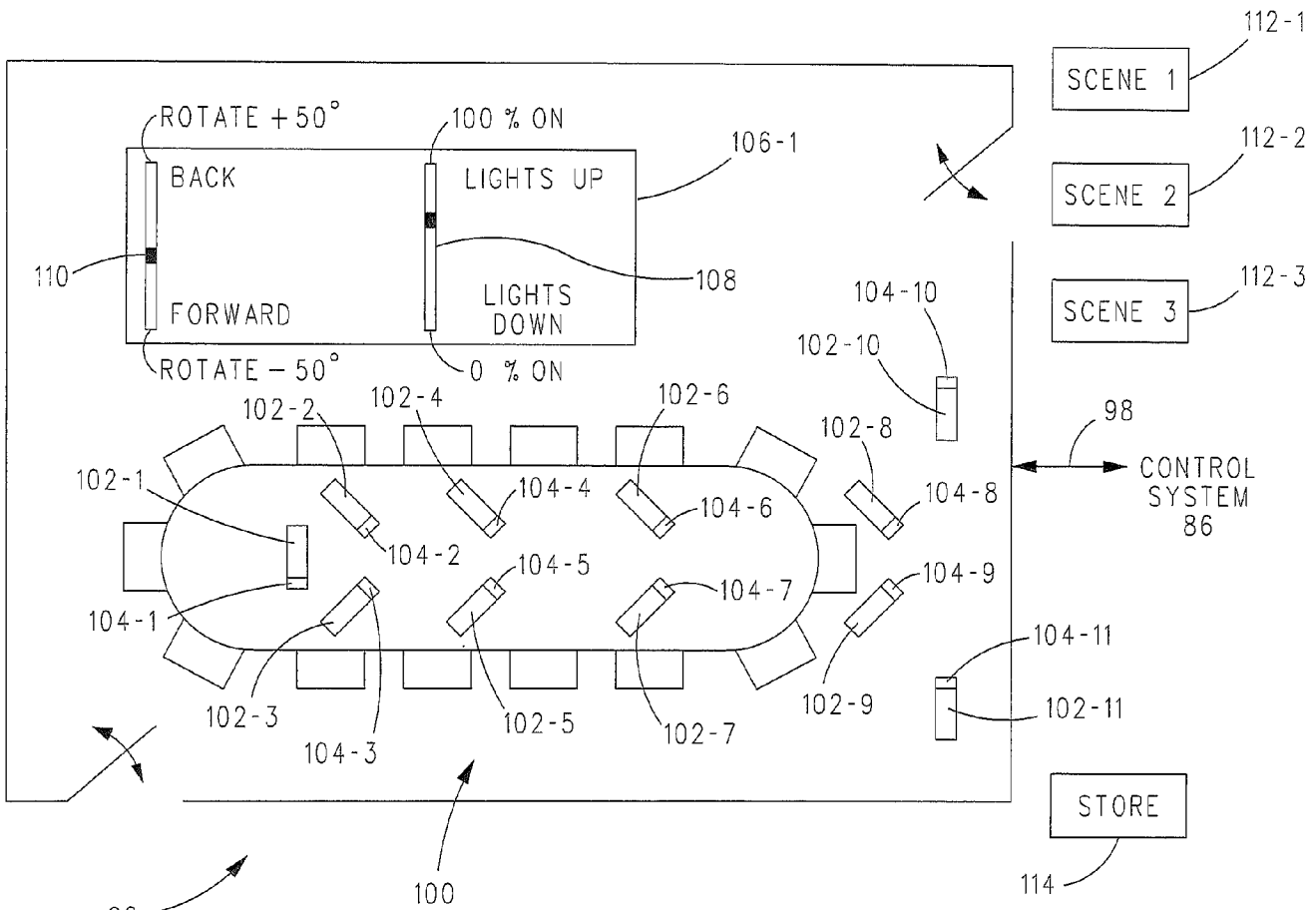
FIG. 21 is an illustration of a number of lighting fixtures displayed by the control system of FIG. 20 on the visual display of FIG. 20, including for each lighting fixture an icon and a status block, and further illustrating a virtual control panel including virtual slides, scene icons and a store icon produced on the visual display of FIG. 20 under the control of the software program controlling the control system of FIG. 20.

With reference to FIG. 21 and with continuing reference to FIG. 20, control system 86 can include an integral display (not shown) or can be coupled to a remote display 96 via a wired or wireless connection 98. Under the control of the software program, control system 86 can display on display 96 a virtual representation 100 of one or more lighting fixtures 2/2' under the control of control system 86. Desirably, each lighting fixture 2/2' is depicted by an icon 102 on virtual representation 100. Each icon 102 represents a single lighting fixture 2/2' of the type discussed above that can be controlled by control system 86. Where virtual representation 100 includes a plurality of icons 102 representing a plurality of lighting fixture 2/2', e.g., icons 102-1-102-11 representing eleven different lighting fixtures 2/2', the relative arrangement and orientation of the plurality of icons 102 on virtual representation 100 desirably corresponds to the arrangement and orientation of the physical lighting fixtures 2/2' represented by said icons 102 to facilitate the intuitive individual control of each lighting fixture 2/2' represented by its corresponding icon 102 in the manner to be described hereinafter. However, this is not to be construed as limiting the invention.

It is envisioned that virtual representation 100 can also include one or more additional icons that represent physical objects in proximity to the physical lighting fixtures 2/2' represented by icons 102. These additional icons can represent a table, chairs, doors, windows, and the like. However, the inclusion of these additional icons on virtual representation 100 is optional and is not to be construed as limiting the invention.

Optionally, each icon 102-1-102-11 can include a status block 104-1-104-11 for displaying the status of the lighting fixture 2/2' associated with said icon 102. Under the control of the software program, control system 86 can have each status block 104 display operating parameters of the lighting fixture 2/2' represented by the corresponding icon 102. For example, without limitation, status block 104-1 can display the percent on status of one or more lamps of the lighting fixture 2/2' associated with icon 102-1 between 0% and 100%, and/or can display the rotational state of one or more lamp carriage assemblies 28, 28', and/or 28", e.g., ±50°, of the lighting fixture 2/2' associated with icon 102-1.

Desirably, the software program controlling control system 86 is responsive to the activation of each icon 102 in any suitable and/or desirable manner, such as a finger touch, a stylist touch, or the selection of a computer generated pointer icon, to display a virtual control panel 106 on display 96. For example, in response to the selection of icon 102-1 in any suitable and/or desirable manner, the software program controlling control system 86 causes a virtual control panel 106-1 to be displayed on display 96. In one non-limiting embodiment, virtual control panel 106-1 can include a first virtual slide 108 for controlling the on-off or percent on state of one or more lamps of one or more lamp carriage assemblies 28, 28', and/or 28" of the lighting fixture 2/2' associated with icon 102-1, and a second virtual slide 110 for controlling the positive and negative rotation (from the home position) of one or more lamp carriage assemblies 28, 28', and/or 28" of the lighting fixture 2/2' associated with icon 102-1. In the case where icon 102-1 represents a lighting fixture 2 having a single lamp carriage assembly 28, 28', or 28", virtual control panel 106-1 can be limited to displaying first virtual slide 108 and second virtual slide 110 as shown in FIG. 21. However, where icon 102-1 represents a lighting fixture 2' having two or more lamp carriage assemblies 28, 28', and/or 28", virtual control panel 106-1 can display for each said lamp carriage assembly 28, 28', and/or 28" first and second virtual slides 108, 110. For example, if a lighting fixture 2' associated with icon 102-1 includes two lamp carriage assemblies 28, 28', and/or 28", virtual control panel can include for one of said lamp carriage assemblies a first pair of virtual slides 108, 110 and can include for the other of said lamp carriage assemblies a second set of virtual slides 108, 110. However, this is not to be construed as limiting the invention since it is envisioned that a single set of virtual slides 108 and 110 can be utilized for simultaneously controlling the on-off or percent on state of each lamp and the rotation of each lamp carriage assembly of the lighting fixture 2' associated with icon 102-1.

Once the on-off or percent on state of each lamp and the rotation of each lamp carriage assembly of the lighting fixture 2/2' associated with icon 102-1 have been set as desired, virtual control panel 106-1 can be removed from virtual representation 100 in any suitable or desirable manner, such as, without limitation, by selecting icon 102-1 a second time. Hence, the first selection of icon 102-1 will cause virtual control panel 106-1 to be displayed in virtual representation 100 while the second selection of icon 102-1 will remove virtual control panel 106-1 from virtual representation 100. In a similar manner, each other icon 102-2-102-11 can be individually selected to display a corresponding virtual control panel 106 that can be utilized for controlling the on-off or percent on state of one or more lamps and/or the rotation of one or more lamp carriage assemblies of the lighting fixture 2/2' associated with said icon 102.

Optionally, under the control of the software program, control system 86 can also display on display 96 one or more scene icons 112 and a store icon 114 that can be utilized for programming the on-off percentage of one or more lamps and/or the rotation of one or more lamp carriage assemblies of the lighting fixtures 2/2' represented by icons 102-1-102-11. For example, following the adjustment of the on-off percentage of each lamp and/or the rotation of each lamp carriage assembly of each lighting fixture 2/2' represented by an icon 102 of virtual representation 100 to a desired state in the manner described above, store icon 114 can be selected in any suitable or desirable manner followed by the selection of, for example, scene 1 icon 112-1, whereupon the on-off or percent on state of each lamp and the rotation state of each lamp carriage assembly is stored in a memory of control system 86 in connection with the scene one icon 112-1 for subsequent retrieval. Thereafter, when it is desired to have the on-off or percent on state of all of the lamps and the rotational states of all of the lamp carriage assemblies of the lighting fixtures 2/2' represented by icons 102-1-102-11 set to the scene 1 programmed state, scene 1 icon 112-1 is selected in any suitable or desirable manner. In response to selecting scene 1 icon 112-1, control system 86 recalls from its memory the on-off or percent on state of each lamp and recalls from its memory the rotational state of each lamp carriage assembly of each lighting fixture 2/2' represented by icons 102-1-102-11 and causes said lamps and lamp carriage assemblies to assume said recalled states.

Hence, as can be seen, the on-off or percent on state of each lamp and the rotational state of each lamp carriage assembly of each lighting fixture 2/2' represented by an icon 102 of virtual representation 100 can be programmed into control system 86 for subsequent retrieval. Desirably, a number of different on-off or percent on states of the lamps and the rotational states of the lamp carriage assemblies of the lighting fixtures 2/2' associated with icons 102-1-102-11 can be programmed into control system 86 via individually selectable scene icons 112 by first selecting store icon 114 and then selecting the corresponding scene icon 112 for subsequent retrieval and setting in response to activating the corresponding scene button by itself. In this manner, a number of different lighting scenes can be stored in control system 86 for quick retrieval and setting of the on-off or percent on state of each lamp and the rotational state of each lamp carriage assembly of the lighting fixture 2/2' associated with icons 102-1-102-11. For example, control system 86 can be programmed such that in response to selecting scene 1 icon 112-1, all of the lamps of the lighting fixtures 2/2' associated with icons 102-1-102-11 assume their fully-on states and the lamp carriage assemblies associated with said lighting fixtures 2/2' assume their home positions (directing light directly downward). In contrast, the scene 2 icon 112-2 can be programmed whereupon in response to selecting the scene 2 icon 112-2, the on-off or percent on state of one or more lamps and/or the rotational state of one or more lamp carriage assemblies of the lighting fixtures 2/2' associated with icons 102-1-102-11 assume different state(s) than the state(s) associated with scene one icon 112-1. Hence, different combinations of on-off or percent on state of the lamps and/or the rotational states of the lamp carriage assemblies of the lighting fixtures 2/2' associated with icons 102-1-102-11 can be programmed into control system 86 for quick retrieval in response to selecting one of the scene icons 112.

The present invention has been described with reference to the preferred embodiments. Obvious modifications and alterations will occur to others upon reading and understanding the preceding detailed description. It is intended that the invention be construed as including all such modifications and alterations insofar as they come within the scope of the appended claims or the equivalents thereof.

The invention claimed is:

1. A lighting fixture comprising:

a housing;

at least one lamp carriage assembly disposed inside the housing and supporting one or more light emitting diodes coupled to a heat sink; and at least one motor coupled between the housing and the lamp carriage assembly, said motor operative for pivoting the lamp carriage assembly relative to the housing about a pivot axis of the lamp carriage assembly, wherein the heat sink and an open side of the housing are positioned on opposite sides of the pivot axis of the lamp carriage assembly.

2. The lighting fixture of claim 1, wherein the motor is operative for pivoting the lamp carriage assembly under the control of a controller which controls the motor via wired, or wireless, or both wired and wireless communication.

3. The lighting fixture of claim 1, wherein the motor is operative for pivoting the lamp carriage assembly about its pivot axis in a first direction, a second direction, or both the first and second directions.

4. The lighting fixture of claim 1, wherein two lamp carriage assemblies are disposed side-by-side in the housing.

5. The lighting fixture of claim 4, wherein each lamp carriage assembly is pivotable about its pivot axis in a first direction, a second direction, or both the first and second directions independently of each other lamp carriage assembly.

6. The lighting fixture of claim 5, wherein two motors are coupled between the two lamp carriage assemblies and the housing, with each motor coupled between one of the lamp carriage assemblies and the housing.

7. The lighting fixture of claim 1, further including:

a reflector disposed in the lamp carriage assembly such that light output by at least one of the one or more light emitting diodes is directed by the reflector toward the open side of the housing.

8. The lighting fixture of claim 1, wherein:

the housing is a rectangular box-like structure having the open side; and the lamp carriage assembly supports the one or more light emitting diodes to output light via the open side of the housing.

9. A lighting fixture comprising:

a housing defining an axis;

a first lamp carriage assembly supported inside the housing for pivoting about a pivot axis of the first lamp carriage assembly that is parallel with the axis of the housing;

one or more light emitting diodes carried by the first lamp carriage assembly, wherein the one or more light emitting diodes carried by the first lamp carriage assembly are coupled to a first heat sink; and a first motor coupled between the housing and the first lamp carriage assembly and operative for pivoting the first lamp carriage assembly relative to the housing about the pivot axis of the first lamp carriage assembly, wherein the first heat sink and an open side of the housing are positioned on opposite sides of the pivot axis of the first lamp carriage assembly.

10. The lighting fixture of claim 9, further comprising:

a second lamp carriage assembly supported inside the housing for pivoting about a pivot axis of the second lamp carriage assembly that is parallel with the axis of the housing;

one or more light emitting diodes carried by the second lamp carriage assembly, wherein the one or more light emitting diodes carried by the second lamp carriage assembly are coupled to a second heat sink; and a second motor coupled between the housing and the second lamp carriage assembly and operative for pivoting the second lamp carriage assembly relative to the housing about the pivot axis of the second lamp carriage assembly, wherein the second heat sink and the open side of the housing are positioned on opposite sides of the pivot axis of the second lamp carriage assembly.

11. The lighting fixture of claim 10, wherein each lamp carriage assembly is pivotable about its pivot axis in a first direction, a second direction, or both the first and second directions independently of the other lamp carriage assembly.

* * * * *